US008151874B2

(12) United States Patent
Schultz et al.

(10) Patent No.: US 8,151,874 B2
(45) Date of Patent: Apr. 10, 2012

(54) THERMAL RECOVERY OF SHALLOW BITUMEN THROUGH INCREASED PERMEABILITY INCLUSIONS

(75) Inventors: Roger L. Schultz, Ninnekah, OK (US); Travis W. Cavender, Angleton, TX (US); Grant Hocking, Alpharetta, GA (US)

(73) Assignee: Halliburton Energy Services, Inc., Houston, TX (US)

( * ) Notice: Subject to any disclaimer, the term of this patent is extended or adjusted under 35 U.S.C. 154(b) by 393 days.

(21) Appl. No.: 12/269,995

(22) Filed: Nov. 13, 2008

(65) Prior Publication Data

US 2009/0101347 A1 Apr. 23, 2009

Related U.S. Application Data

(63) Continuation-in-part of application No. 11/626,112, filed on Jan. 23, 2007, now Pat. No. 7,591,306, which is a continuation-in-part of application No. 11/379,828, filed on Apr. 24, 2006, now abandoned, which is a continuation-in-part of application No. 11/277,815, filed on Mar. 29, 2006, now abandoned, which is a continuation-in-part of application No. 11/363,540, filed on Feb. 27, 2006, now Pat. No. 7,748,458.

(51) Int. Cl.
*E21B 28/00* (2006.01)
*E21B 43/26* (2006.01)

(52) U.S. Cl. ..... 166/177.5; 166/308.1

(58) Field of Classification Search ..... 166/177.5, 166/308.1, 212

See application file for complete search history.

(56) References Cited

U.S. PATENT DOCUMENTS

| | | | |
|---|---|---|---|
| 1,789,993 | A | 1/1931 | Switzer |
| 2,178,554 | A | 11/1939 | Bowie |
| 2,548,360 | A | 4/1951 | Germain |
| 2,634,961 | A | 4/1953 | Ljungstrom |
| 2,642,142 | A | 6/1953 | Clark |
| 2,687,179 | A | 8/1954 | Dismukes |
| 2,732,195 | A | 1/1956 | Ljungstrom |
| 2,780,450 | A | 2/1957 | Ljungstrom |

(Continued)

FOREIGN PATENT DOCUMENTS

CA 2543886 A1 4/2006

(Continued)

OTHER PUBLICATIONS

Office Action issued Jan. 26, 2009, for U.S. Appl. No. 11/832,615, 23 pages.

(Continued)

*Primary Examiner* — Angela M DiTrani
(74) *Attorney, Agent, or Firm* — Marlin R. Smith

(57) ABSTRACT

Systems and methods for thermal recovery of shallow bitumen using increased permeability inclusions. A method of producing hydrocarbons from a subterranean formation includes the steps of: propagating at least one generally planar inclusion outward from a wellbore into the formation; injecting a fluid into the inclusion, thereby heating the hydrocarbons; and during the injecting step, producing the hydrocarbons from the wellbore. A well system includes at least one generally planar inclusion extending outward from a wellbore into a formation; a fluid injected into the inclusion, hydrocarbons being heated as a result of the injected fluid; and a tubular string through which the hydrocarbons are produced, the tubular string extending to a location in the wellbore below the inclusion, and the hydrocarbons being received into the tubular string at that location.

17 Claims, 19 Drawing Sheets

U.S. PATENT DOCUMENTS 2,862,564 A 12/1958 Bostock
2,870,843 A 1/1959 Rodgers, Jr.
3,058,730 A 10/1962 Bays
3,059,909 A 10/1962 Wise
3,062,286 A * 11/1962 Wyllie ..... 166/308.1
3,071,481 A 1/1963 Beach et al.
3,225,828 A 12/1965 Wisenbaker et al.
3,270,816 A 9/1966 Staadt
3,280,913 A 10/1966 Smith
3,301,723 A 1/1967 Chrisp
3,338,317 A 8/1967 Shore
3,349,847 A 10/1967 Smith et al.
3,353,599 A 11/1967 Swift
3,690,380 A 9/1972 Grable
3,727,688 A 4/1973 Clampitt
3,739,852 A 6/1973 Woods et al.
3,779,915 A 12/1973 Kucera
3,884,303 A 5/1975 Closmann
3,888,312 A 6/1975 Tiner et al.
3,913,671 A 10/1975 Redford et al.
3,948,325 A 4/1976 Winston et al.
3,994,340 A 11/1976 Anderson et al.
4,005,750 A 2/1977 Shuck
4,018,293 A 4/1977 Keller
4,085,803 A 4/1978 Butler
4,099,570 A 7/1978 Vandergrift
4,114,687 A 9/1978 Payton
4,116,275 A 9/1978 Butler et al.
4,119,151 A 10/1978 Smith
4,271,696 A 6/1981 Wood
4,280,559 A 7/1981 Best
4,311,194 A 1/1982 White
4,344,485 A 8/1982 Butler
4,450,913 A 5/1984 Allen et al.
4,454,916 A 6/1984 Shu
4,474,237 A 10/1984 Shu
4,513,819 A 4/1985 Islip et al.
4,519,454 A 5/1985 McMillen
4,566,536 A 1/1986 Holmes
4,597,441 A 7/1986 Ware et al.
4,598,770 A 7/1986 Shu et al.
4,625,800 A 12/1986 Venkatesan
4,678,037 A 7/1987 Smith
4,696,345 A 9/1987 Hsueh
4,697,642 A 10/1987 Vogel
4,706,751 A 11/1987 Gondouin
4,716,960 A 1/1988 Eastlund et al.
4,834,181 A 5/1989 Uhri et al.
4,926,941 A 5/1990 Glandt et al.
4,977,961 A 12/1990 Avasthi
4,993,490 A 2/1991 Stephens et al.
5,002,431 A 3/1991 Heymans
5,010,964 A 4/1991 Cornette
5,036,918 A 8/1991 Jennings, Jr. et al.
5,046,559 A 9/1991 Glandt
5,054,551 A 10/1991 Duerksen
5,060,287 A 10/1991 Van Egmond
5,060,726 A 10/1991 Glandt et al.
5,065,818 A 11/1991 Van Egmond
5,103,911 A 4/1992 Heijnen
5,105,886 A 4/1992 Strubhar et al.
5,111,881 A 5/1992 Soliman et al.
5,123,487 A 6/1992 Harris et al.
5,131,471 A * 7/1992 Duerksen et al. ..... 166/303
5,145,003 A 9/1992 Duerksen
5,148,869 A 9/1992 Sanchez
5,211,230 A 5/1993 Ostapovich et al.
5,211,714 A 5/1993 Jordan et al.
5,215,146 A 6/1993 Sanchez
5,255,742 A 10/1993 Mikus
5,273,111 A 12/1993 Brannan et al.
5,297,626 A 3/1994 Vinegar et al.
5,318,123 A 6/1994 Venditto et al.
5,325,923 A 7/1994 Surjaatmadja et al.
5,335,724 A 8/1994 Venditto et al.
5,339,897 A 8/1994 Leaute
5,372,195 A 12/1994 Swanson et al.
5,386,875 A 2/1995 Venditto et al.
5,392,854 A 2/1995 Vinegar et al.
5,394,941 A 3/1995 Venditto et al.
5,396,957 A 3/1995 Surjaatmadja et al.
5,404,952 A 4/1995 Vinegar et al.
5,407,009 A 4/1995 Butler et al.
5,431,224 A 7/1995 Laali
5,431,225 A 7/1995 Abass et al.
5,472,049 A 12/1995 Chaffee et al.
5,494,103 A 2/1996 Surjaatmadja et al.
5,547,023 A 8/1996 McDaniel et al.
5,564,499 A 10/1996 Willis et al.
5,607,016 A 3/1997 Butler
5,626,191 A 5/1997 Greaves et al.
5,667,011 A 9/1997 Gill et al.
5,743,334 A 4/1998 Nelson
5,765,642 A 6/1998 Surjaatmadja
5,824,214 A 10/1998 Paul et al.
5,829,520 A 11/1998 Johnson
5,862,858 A 1/1999 Wellington et al.
5,871,637 A 2/1999 Brons
5,899,269 A 5/1999 Wellington et al.
5,899,274 A 5/1999 Frauenfeld et al.
5,944,446 A 8/1999 Hocking
5,954,946 A 9/1999 Klazinga et al.
5,981,447 A 11/1999 Chang et al.
6,003,599 A 12/1999 Huber et al.
6,023,554 A 2/2000 Vinegar et al.
6,056,057 A 5/2000 Vinegar et al.
6,076,046 A 6/2000 Vasudevan
6,079,499 A 6/2000 Mikus et al.
6,116,343 A 9/2000 Van Petegem et al.
6,142,229 A 11/2000 Branson, Jr. et al.
6,176,313 B1 1/2001 Coenen et al.
6,216,783 B1 4/2001 Hocking et al.
6,283,216 B1 9/2001 Ohmer
6,318,464 B1 11/2001 Mokrys
6,330,914 B1 12/2001 Hocking et al.
6,360,819 B1 3/2002 Vinegar
6,372,678 B1 4/2002 Youngman et al.
6,412,557 B1 7/2002 Ayasse et al.
6,443,227 B1 9/2002 Hocking et al.
6,446,727 B1 9/2002 Zemlak et al.
6,508,307 B1 1/2003 Almaguer
6,543,538 B2 4/2003 Tolman et al.
6,591,908 B2 7/2003 Nasr
6,662,874 B2 12/2003 Surjaatmadja et al.
6,708,759 B2 3/2004 Leaute et al.
6,719,054 B2 4/2004 Cheng et al.
6,722,431 B2 4/2004 Karanikas et al.
6,722,437 B2 4/2004 Vercaemer et al.
6,725,933 B2 4/2004 Middaugh et al.
6,732,800 B2 5/2004 Acock et al.
6,769,486 B2 8/2004 Lim et al.
6,779,607 B2 8/2004 Middaugh et al.
6,782,953 B2 8/2004 Maguire et al.
6,792,720 B2 9/2004 Hocking
6,883,607 B2 4/2005 Nenniger et al.
6,883,611 B2 4/2005 Smith et al.
6,991,037 B2 1/2006 Hocking
7,044,225 B2 * 5/2006 Haney et al. ..... 166/308.1
7,055,598 B2 6/2006 Ross et al.
7,059,415 B2 6/2006 Bosma et al.
7,066,284 B2 6/2006 Wylie et al.
7,069,989 B2 7/2006 Marmorshteyn et al.
7,228,908 B2 6/2007 East, Jr. et al.
7,240,728 B2 7/2007 Cook et al.
7,278,484 B2 10/2007 Vella et al.
7,404,416 B2 7/2008 Schultz et al.
7,412,331 B2 8/2008 Calhoun et al.
7,640,975 B2 1/2010 Cavender et al.
7,640,982 B2 1/2010 Schultz et al.
7,647,966 B2 1/2010 Cavender et al.
7,918,269 B2 4/2011 Cavender et al.
2002/0189818 A1 12/2002 Metcalfe
2003/0192717 A1 10/2003 Smith et al.
2003/0230408 A1 12/2003 Acock et al.
2004/0118574 A1 6/2004 Cook et al.
2004/0177951 A1 9/2004 Hoffman et al.
2005/0145387 A1 7/2005 Hocking

| | | | |
|---|---|---|---|
| 2005/0194143 | A1 | 9/2005 | Xu et al. |
| 2005/0263284 | A1 | 12/2005 | Justus |
| 2006/0131074 | A1 | 6/2006 | Calhoun et al. |
| 2006/0144593 | A1 | 7/2006 | Reddy |
| 2006/0149478 | A1 | 7/2006 | Calhoun et al. |
| 2006/0162923 | A1 | 7/2006 | Ware |
| 2007/0199695 | A1 | 8/2007 | Hocking |
| 2007/0199697 | A1 | 8/2007 | Hocking |
| 2007/0199698 | A1 | 8/2007 | Hocking |
| 2007/0199699 | A1 | 8/2007 | Hocking |
| 2007/0199700 | A1 | 8/2007 | Hocking |
| 2007/0199701 | A1 | 8/2007 | Hocking |
| 2007/0199702 | A1 | 8/2007 | Hocking |
| 2007/0199704 | A1 | 8/2007 | Hocking |
| 2007/0199705 | A1 | 8/2007 | Hocking |
| 2007/0199706 | A1 | 8/2007 | Hocking |
| 2007/0199707 | A1 | 8/2007 | Hocking |
| 2007/0199708 | A1 | 8/2007 | Hocking |
| 2007/0199710 | A1 | 8/2007 | Hocking |
| 2007/0199711 | A1 | 8/2007 | Hocking |
| 2007/0199712 | A1 | 8/2007 | Hocking |
| 2007/0199713 | A1 | 8/2007 | Hocking |
| 2009/0008088 | A1 | 1/2009 | Schultz |
| 2009/0032251 | A1 | 2/2009 | Cavender et al. |
| 2009/0032260 | A1 | 2/2009 | Schultz et al. |
| 2009/0032267 | A1 | 2/2009 | Cavender et al. |
| 2009/0218089 | A1 | 9/2009 | Steele et al. |

FOREIGN PATENT DOCUMENTS

| | | | |
|---|---|---|---|
| EP | 1131534 | B1 | 9/2003 |
| WO | 8100016 | A1 | 1/1981 |
| WO | 0001926 | A1 | 1/2000 |
| WO | 0029716 | A2 | 5/2000 |
| WO | 2004092530 | A2 | 10/2004 |
| WO | 2005065334 | A2 | 7/2005 |
| WO | 2007100956 | A2 | 9/2007 |
| WO | 2007112175 | A2 | 10/2007 |
| WO | 2007112199 | A2 | 10/2007 |
| WO | 2007117787 | A2 | 10/2007 |
| WO | 2007117810 | A2 | 10/2007 |
| WO | 2007117865 | A2 | 10/2007 |
| WO | 2009009336 | A2 | 1/2009 |
| WO | 2009009412 | A2 | 1/2009 |
| WO | 2009009437 | A2 | 1/2009 |
| WO | 2009009445 | A2 | 1/2009 |
| WO | 2009009447 | A2 | 1/2009 |

OTHER PUBLICATIONS

Office Action issued Feb. 2, 2009, for Canadian Patent Application Serial No. 2,596,201, 3 pages.
International Search Report and Written Opinion issued Jan. 2, 2009, for International Patent Application Serial No. PCT/US08/70776, 11 pages.
Office Action issued Jan. 21, 2010 for U.S. Appl. No. 11/610,819, 11 pages.
International Preliminary Report on Patentability issued Feb. 11, 2010, for International Patent Application Serial No. PCT/US08/070756, 10 pages.
International Preliminary Report on Patentability issued Feb. 11, 2010, for International Patent Serial No. PCT/US08/070776, 8 pages.
International Preliminary Report on Patentability issued Feb. 11, 2010, for International Patent Application Serial No. PCT/US08/070780, 7 pages.
Invitation to Pay Additional Fees issued May 12, 2010, for International Patent Application Serial No. PCT/US09/63588, 4 pages.
Office Action issued May 15, 2009, for U.S. Appl. No. 11/610,819, 26 pages.
Office Action issued Jun. 16, 2009, for U.S. Appl. No. 11/832,602, 37 pages.
Office Action issued Jun. 17, 2009, for U.S. Appl. No. 11/832,620, 37 pages.
International Search Report and Written Opinion issued Jul. 2, 2010, for International Patent Application Serial No. PCT/US09/63588, 15 pages.
Office Action issued Jul. 21, 2010, for U.S. Appl. No. 12/625,302, 32 pages.
Office Action issued Sep. 24, 2009, for U.S. Appl. No. 11/966,212, 37 pages.
Office Action issued Sep. 29, 2009, for U.S. Appl. No. 11/610,819, 12 pages.
Office Action issued Oct. 1, 2010, for U.S. Appl. No. 12/797,256, 36 pages.
U.S. Appl. No. 11/832,602, filed Aug. 1, 2007.
U.S. Appl. No. 11/832,620, filed Aug. 1, 2007.
U.S. Appl. No. 11/832,615, filed Aug. 1, 2007.
U.S. Appl. No. 11/610,819, filed Dec. 14, 2006.
U.S. Appl. No. 11/966,212, filed Dec. 28, 2007.
International Search Report and Written Opinion issued Sep. 25, 2008, for International Patent Application Serial No. PCT/US07/87291, 11 pages.
International Search Report and Written Opinion issued Oct. 8, 2008, for International Patent Application Serial No. PCT/US8/70780, 8 pages.
Halliburton Production Optimization, Cobra Frac® Service, Aug. 2005, 2 pages.
Halliburton Drawing No. D00004932, Sep. 10, 1999, 2 pages.
Serata Geomechanics Corporation, "Stress/Property Measurements for Geomechanics," www.serata.conn, dated 2005-2007, 11 pages.
ISTT, "Trenchless Pipe Replacement," Dec. 11, 2006, 1 page.
ISTT, "Rerounding," Dec. 11, 2006, 1 page.
STAR Frac Completion System brochure, Winter/Spring 2006, 4 pages.
Wenlu Zhu, et al., "Shear-enhanced Compaction and Permeability Reduction; Triaxial Extension Tests on Porous Sandstone," Mechanics of Materials, 1997, 16 pages.
S.L. Karner, "What Can Granular Media Teach Us about Deformation in Geothermal Systems?" ARMA, 2005, 12 pages.
M.R. Coop, "The Mechanics of Uncemented Carbonate Sands," Geotechnique vol. 40, No. 4, 1990, pp. 607-626.
M.R. Coop and J.H. Atkinson, "The Mechanics of Cemented Carbonate Sands," Geotechnique vol. 43, No. 1, 1993, pp. 53-67.
T. Cuccovillo and M.R. Coop, "Yielding and Pre-failure Deformation of Structured Sands," Geotechnique vol. 47, No. 3, 1997, pp. 491-508.
Lockner and Stanchits, "Undrained Pore-elastic Response of Sandstones to Deviatoric Stress Change," Porelastic Response of Sandstones, 2002, 30 pages.
Axel Kaselow and Serge Shapiro, "Stress Sensitivity of Elastic Moduli and Electrical Resistivity in Porous Rocks," Journal of Geophysics and Engineering, Feb. 11, 2004, 11 pages.
Lockner and Beeler, "Stress-Induced Anisotropic Porelasticity Response in Sandstone," Jul. 2003, 13 pages.
G.V. Rotta, et al., "Isotropic Yielding in an Artificially Cemented Soil Cured Under Stress;" Geotechnique vol. 53, No. 53, 2003, pp. 493-501.
T.F. Wong and P. Baud, "Mechanical Compaction of Porous Sandstone," Oil and Gas Science and Technology, 1999, pp. 715-727.
U.S. Appl. No. 11545,749, filed Oct. 10, 2006, 30 pages.
U.S. Appl. No. 11/753,314, filed May 24, 2007, 49 pages.
U.S. Appl. No. 11/977,772, filed Oct. 26, 2007, 24 pages.
International Search Report and Written Opinion issued Oct. 22, 2008, for International Patent Application Serial No. PCT/US08/70756, 11 pages.
Office Action issued Jun. 16, 2011, for U.S. Appl. No. 13/036,090, 9 pages.
International Preliminary Report on Patentability issued May 26, 2011, for International Patent Application No. PCT/US09/063588, 11 pages.
Halliburton, "Cobra Frac RR4-EV Packer", product brochure, dated Jun. 1, 2008, 2 pages.
Halliburton Cobra Frac RR4-EV Packer Product Brochure, 2 pages, undated but created prior to Nov. 13, 2008.
Office Action issued May 5, 2011 for Canadian Patent Application No. 2,686,050, 2 pages.

* cited by examiner

THERMAL RECOVERY OF SHALLOW BITUMEN THROUGH INCREASED PERMEABILITY INCLUSIONS

CROSS-REFERENCE TO RELATED APPLICATIONS

The present application is a continuation-in-part of prior application Ser. No. 11/626,112 filed on Jan. 23, 2007 which is a continuation-in-part of prior application Ser. No. 11/379,828 filed on Apr. 24, 2006 which is a continuation-in-part of prior application Ser. No. 11/277,815 filed on Mar. 29, 2006 which is a continuation-in-part of prior application Ser. No. 11/363,540 filed on Feb. 27, 2006. The entire disclosures of these prior applications are incorporated herein by this reference.

BACKGROUND

The present disclosure relates generally to equipment utilized and operations performed in conjunction with a subterranean well and, in an embodiment described herein, more particularly provides for thermal recovery of shallow bitumen through increased permeability inclusions.

A need exists for an effective and economical method of thermally recovering relatively shallow bitumen, such as that found between depths of approximately 70 and 140 meters in the earth. Typically, bitumen can be recovered through surface mining processes down to depths of approximately 70 meters, and steam assisted gravity drainage (SAGD) thermal methods can effectively recover bitumen deposits deeper than approximately 140 meters.

However, recovery of bitumen between depths at which surface mining and SAGD are effective and profitable is not currently practiced. The 70 to 140 meters depth range is too deep for conventional surface mining and too shallow for conventional SAGD operations.

Therefore, it will be appreciated that improvements are needed in the art of thermally producing bitumen and other relatively heavy weight hydrocarbons from earth formations.

SUMMARY

In the present specification, apparatus and methods are provided which solve at least one problem in the art. One example is described below in which increased permeability inclusions are propagated into a formation and steam is injected into an upper portion of the inclusions while bitumen is produced from a lower portion of the inclusions. Another example is described below in which the steam injection is pulsed and a phase control valve permits production of the bitumen, but prevents production of the steam.

In one aspect, a method of producing hydrocarbons from a subterranean formation is provided by this disclosure. The method includes the steps of: propagating at least one generally planar inclusion outward from a wellbore into the formation; injecting a fluid into the inclusion, thereby heating the hydrocarbons; and during the injecting step, producing the hydrocarbons from the wellbore.

In another aspect, a well system for producing hydrocarbons from a subterranean formation intersected by a wellbore is provided. The system includes at least one generally planar inclusion extending outward from the wellbore into the formation. A fluid is injected into the inclusion, with the hydrocarbons being heated as a result of the injected fluid. The hydrocarbons are produced through a tubular string, with the tubular string extending to a location in the wellbore below the inclusion. The hydrocarbons are received into the tubular string at that location.

In yet another aspect, a method of producing hydrocarbons from a subterranean formation includes the steps of: propagating at least one generally planar inclusion outward from a wellbore into the formation; injecting a fluid into the inclusion, thereby heating the hydrocarbons, the injecting step including varying a flow rate of the fluid into the inclusion while the fluid is continuously flowed into the inclusion; and during the injecting step, producing the hydrocarbons from the wellbore.

In a further aspect, a method of propagating at least one generally planar inclusion outward from a wellbore into a subterranean formation includes the steps of: providing an inclusion initiation tool which has at least one laterally outwardly extending projection, a lateral dimension of the inclusion initiation tool being larger than an internal lateral dimension of a portion of the wellbore; forcing the inclusion initiation tool into the wellbore portion, thereby forcing the projection into the formation to thereby initiate the inclusion; and then pumping a propagation fluid into the inclusion, thereby propagating the inclusion outward into the formation.

These and other features, advantages, benefits and objects will become apparent to one of ordinary skill in the art upon careful consideration of the detailed description of representative embodiments hereinbelow and the accompanying drawings, in which similar elements are indicated in the various figures using the same reference numbers.

DETAILED DESCRIPTION

It is to be understood that the various embodiments described herein may be utilized in various orientations, such as inclined, inverted, horizontal, vertical, etc., and in various configurations, without departing from the principles of the present disclosure. The embodiments are described merely as examples of useful applications of the principles of the disclosure, which are not limited to any specific details of these embodiments.

Figure 1:
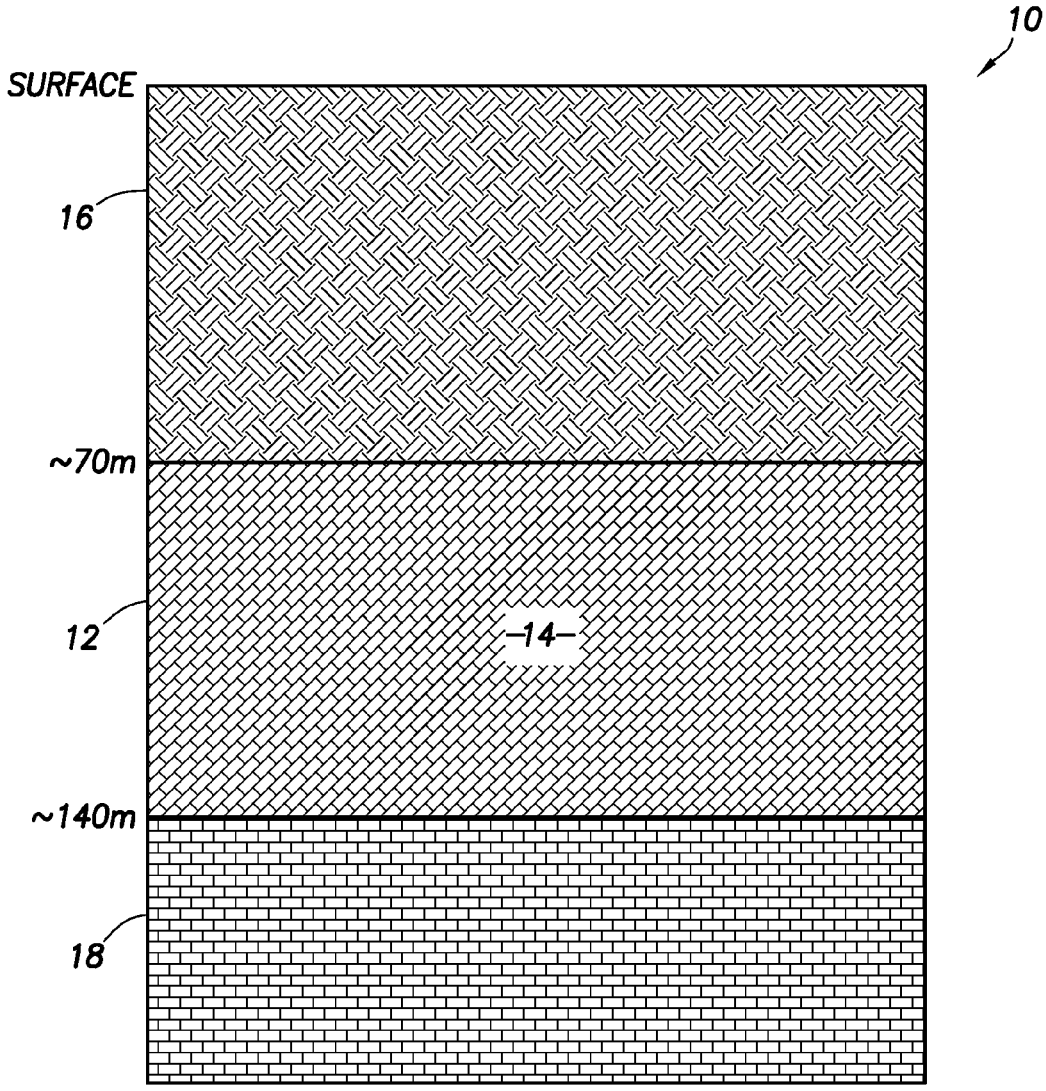
FIG. 1 is a schematic cross-sectional view of representative earth formations in which a method embodying principles of the present disclosure may be practiced.

Representatively illustrated in FIGS. 1-10 are a well system 10 and associated methods which embody principles of the present disclosure. In this well system 10 as depicted in FIG. 1, an earth formation 12 contains a deposit of bitumen or other relatively heavy weight hydrocarbons 14.

It is desired to produce the hydrocarbons 14, but they are located at a depth of between approximately 70 and 140 meters, where recovery by surface mining and SAGD methods are impractical. However, it should be clearly understood that the formation 12 and the hydrocarbons 14 could be at depths of other than 70-140 meters in keeping with the principles of this disclosure.

Preferably, the formation 12 is relatively unconsolidated or poorly cemented. However, in some circumstances the formation 12 may be able to bear substantial principal stresses.

An overburden layer 16 extends from the formation 12 to the surface, and a relatively impermeable layer 18 underlies the formation 12. Each of the layers 16, 18 may include multiple sub-layers or zones, whether relatively permeable or impermeable.

Figure 2:
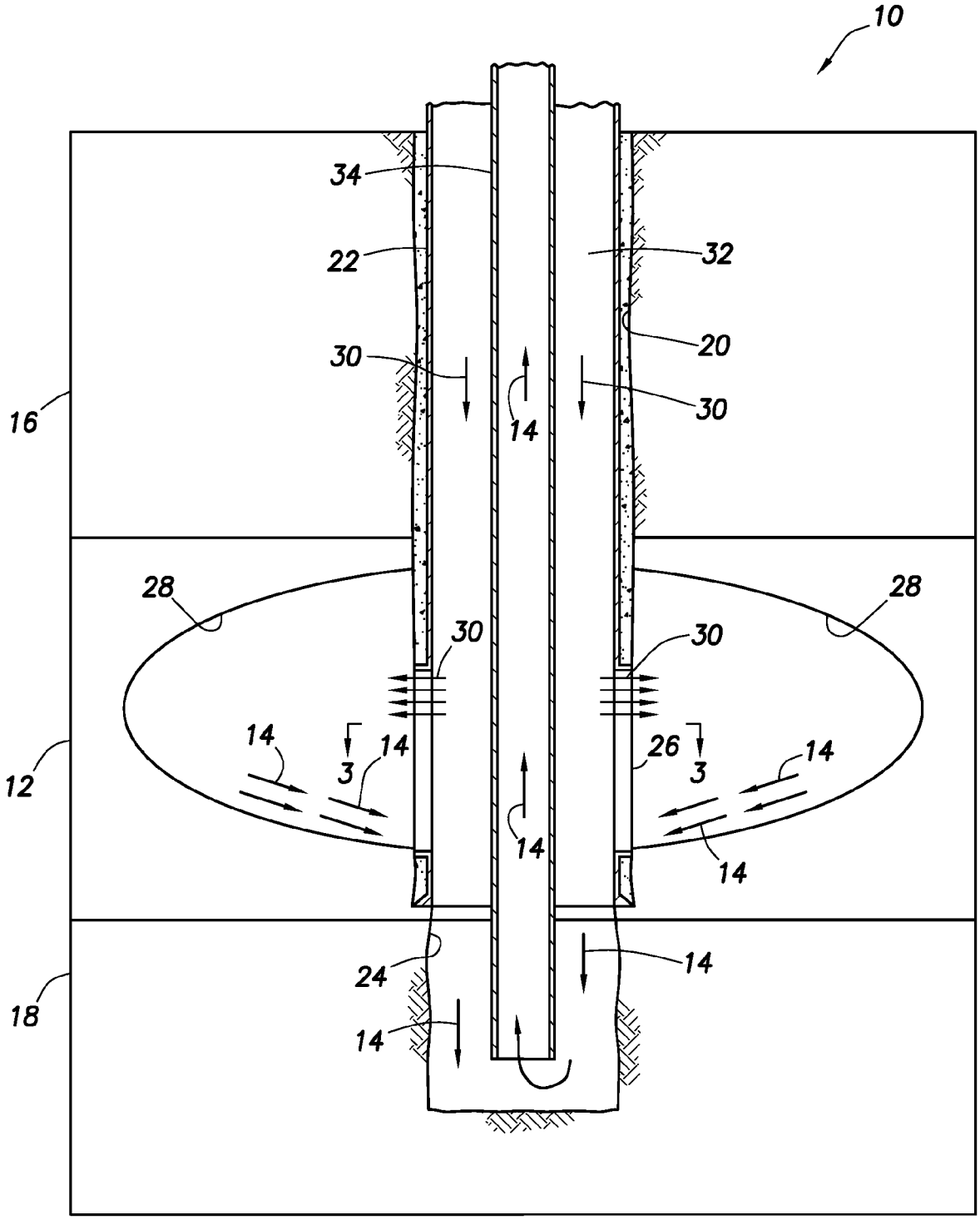
FIG. 2 is a schematic partially cross-sectional view showing production of bitumen from a formation using the method and associated apparatus.

Referring specifically now to FIG. 2, the well system 10 is depicted after a wellbore 20 has been drilled into the formation 12. A casing string 22 has been installed and cemented in the wellbore 20. An open hole sump portion 24 of the wellbore 20 is then drilled downward from the lower end of the casing string 22.

As used herein, the term "casing" is used to indicate a protective lining for a wellbore. Casing can include tubular elements such as those known as casing, liner or tubing. Casing can be substantially rigid, flexible or expandable, and can be made of any material, including steels, other alloys, polymers, etc.

Included in the casing string 22 is a tool 26 for forming generally planar inclusions 28 outward from the wellbore 20 into the formation 12. Although only two inclusions 28 are visible in FIG. 2, any number of inclusions (including one) may be formed into the formation 12 in keeping with the principles of this disclosure.

The inclusions 28 may extend radially outward from the wellbore 20 in predetermined azimuthal directions. These inclusions 28 may be formed simultaneously, or in any order. The inclusions 28 may not be completely planar or flat in the geometric sense, in that they may include some curved portions, undulations, tortuosity, etc., but preferably the inclusions do extend in a generally planar manner outward from the wellbore 20.

The inclusions 28 may be merely inclusions of increased permeability relative to the remainder of the formation 12, for example, if the formation is relatively unconsolidated or poorly cemented. In some applications (such as in formations which can bear substantial principal stresses), the inclusions 28 may be of the type known to those skilled in the art as "fractures."

The inclusions 28 may result from relative displacements in the material of the formation 12, from washing out, etc. Suitable methods of forming the inclusions 28 (some of which do not require use of a special tool 26) are described in U.S. Pat. Nos. 7,832,477, 7,640,982, 7,647,966, 7,640,975, and 7,814,978. The entire disclosures of these prior patents are incorporated herein by this reference.

Figure 3:
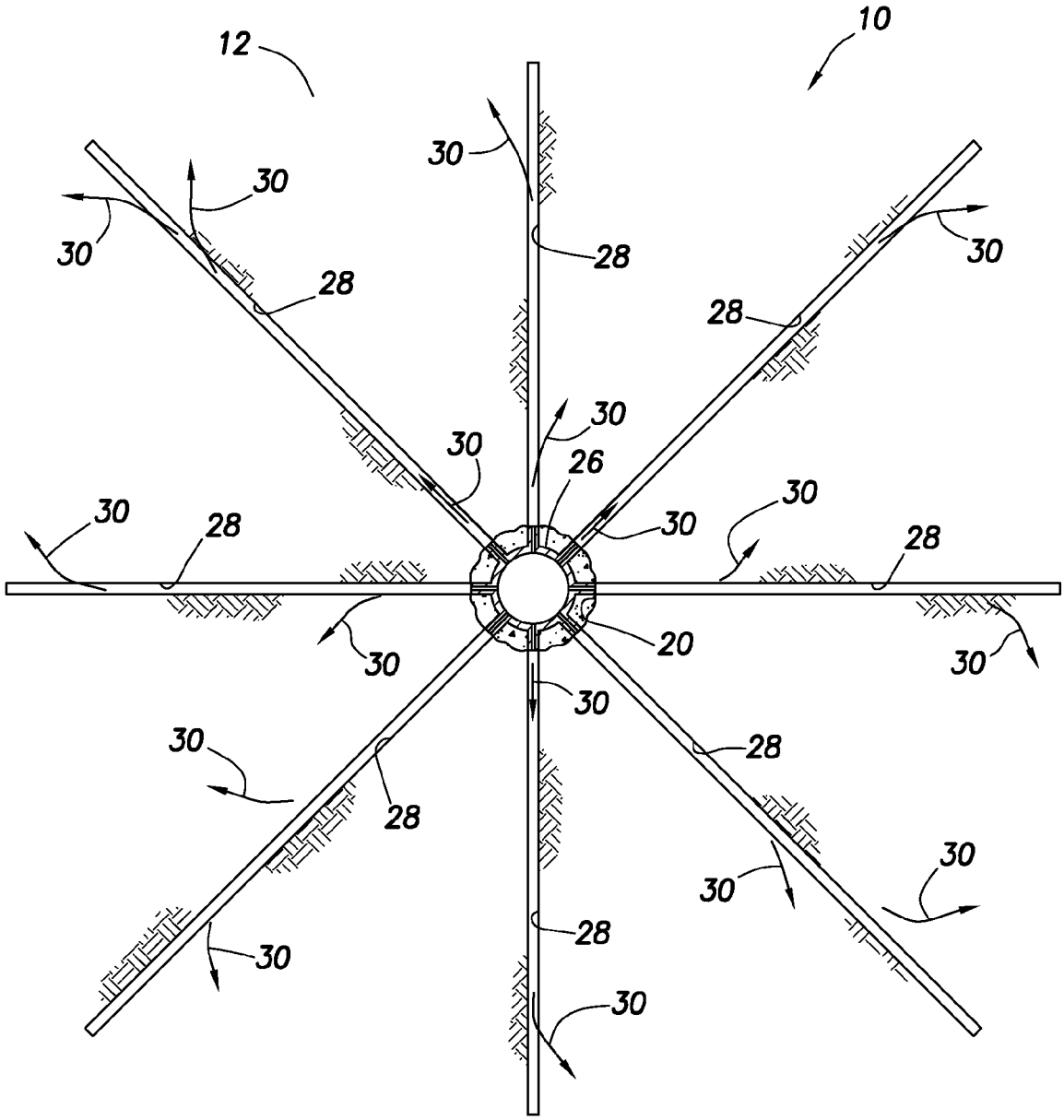
FIG. 3 is an enlarged scale cross-sectional view of increased permeability inclusions propagated into the formation in the method.

The inclusions 28 may be azimuthally oriented in preselected directions relative to the wellbore 20, as representatively illustrated in FIG. 3. Although the wellbore 20 and inclusions 28 are vertically oriented as illustrated in FIG. 2, they may be oriented in any other direction in keeping with the principles of this disclosure.

As depicted in FIG. 2, a fluid 30 is injected into the formation 12. The fluid 30 is flowed downwardly via an annulus 32 formed radially between the casing string 22 and a tubular production string 34. The tubular string 34 extends downwardly to a location which is below the inclusions 28 (e.g., in the sump portion 24).

The fluid 30 flows outward into the formation 12 via the inclusions 28. As a result, the hydrocarbons 14 in the formation 12 are heated. For example, the fluid 30 may be steam or another liquid or gas which is capable of causing the heating of the hydrocarbons 14.

Suitably heated, the hydrocarbons 14 become mobile (or at least more mobile) in the formation 12 and can drain from the formation into the wellbore 20 via the inclusions 28. As shown in FIG. 2, the hydrocarbons 14 drain into the wellbore 20 and accumulate in the sump portion 24. The hydrocarbons 14 are, thus, able to be produced from the well via the production string 34.

The hydrocarbons 14 may flow upward through the production string 34 as a result of the pressure exerted by the fluid 30 in the annulus 32. Alternatively, or in addition, supplemental lift techniques may be employed to encourage the hydrocarbons 14 to flow upward through the production string 34.

Figure 4:
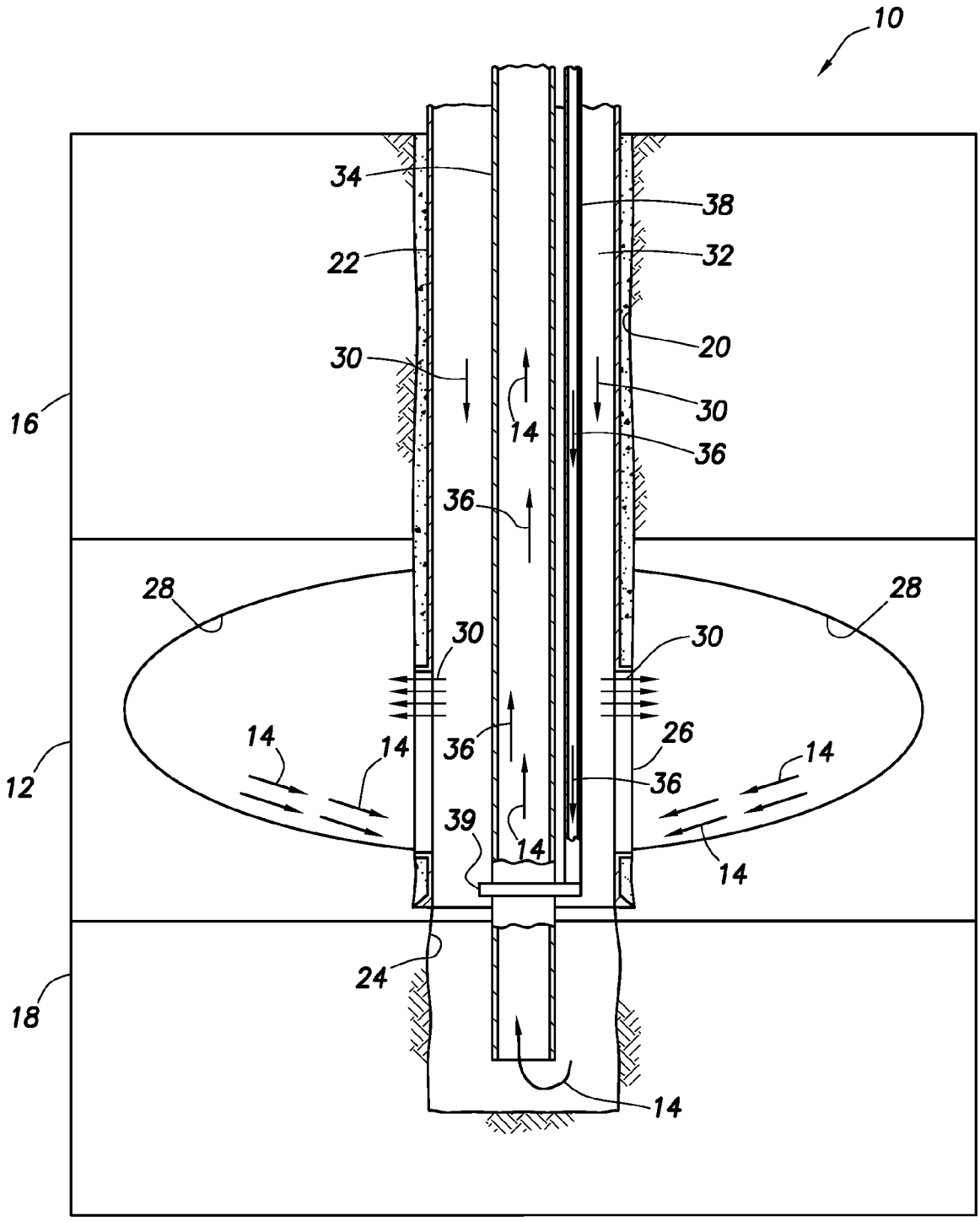
FIG. 4 is a schematic partially cross-sectional view of a completed well system embodying principles of the present disclosure.

In FIG. 4, a relatively less dense fluid 36 (i.e., less dense as compared to the hydrocarbons 14) is injected into the tubular string 34 via another tubular injection string 38 installed in the well alongside the production string 34. The fluid 36 may be steam, another gas such as methane, or any other relatively less dense fluid or combination of fluids. Conventional artificial lift equipment (such as a gas lift mandrel 39, etc.) may be used in this method.

Figure 5:
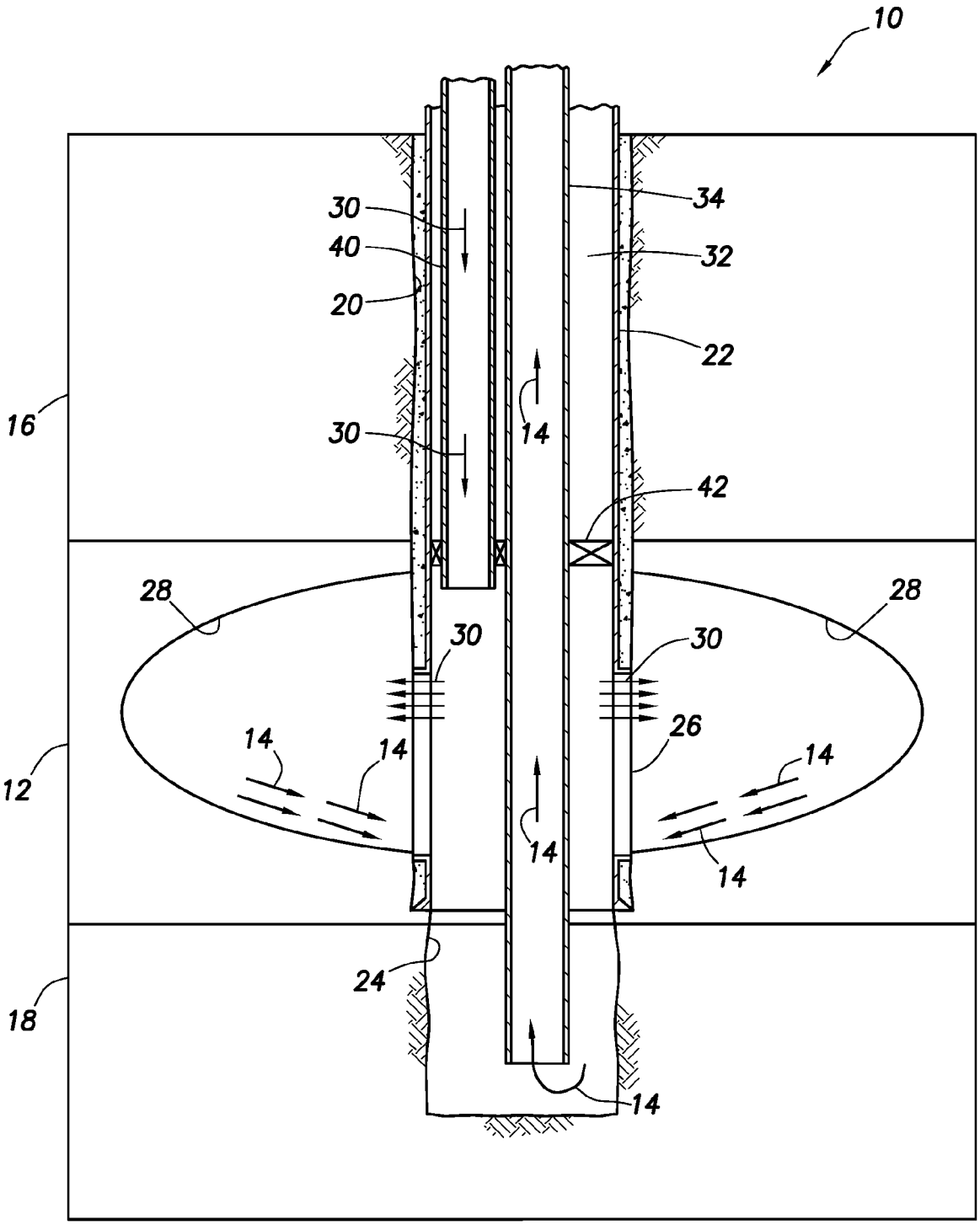
FIG. 5 is a schematic partially cross-sectional view of another completed well system embodying principles of the present disclosure.

In FIG. 5, the fluid 30 is injected into the wellbore 20 via another tubular injection string 40. A packer 42 set in the wellbore 20 above the inclusions 28 helps to contain the pressure exerted by the fluid 30, and thereby aids in forcing the hydrocarbons 14 to flow upward through the production string 34.

Figure 6:
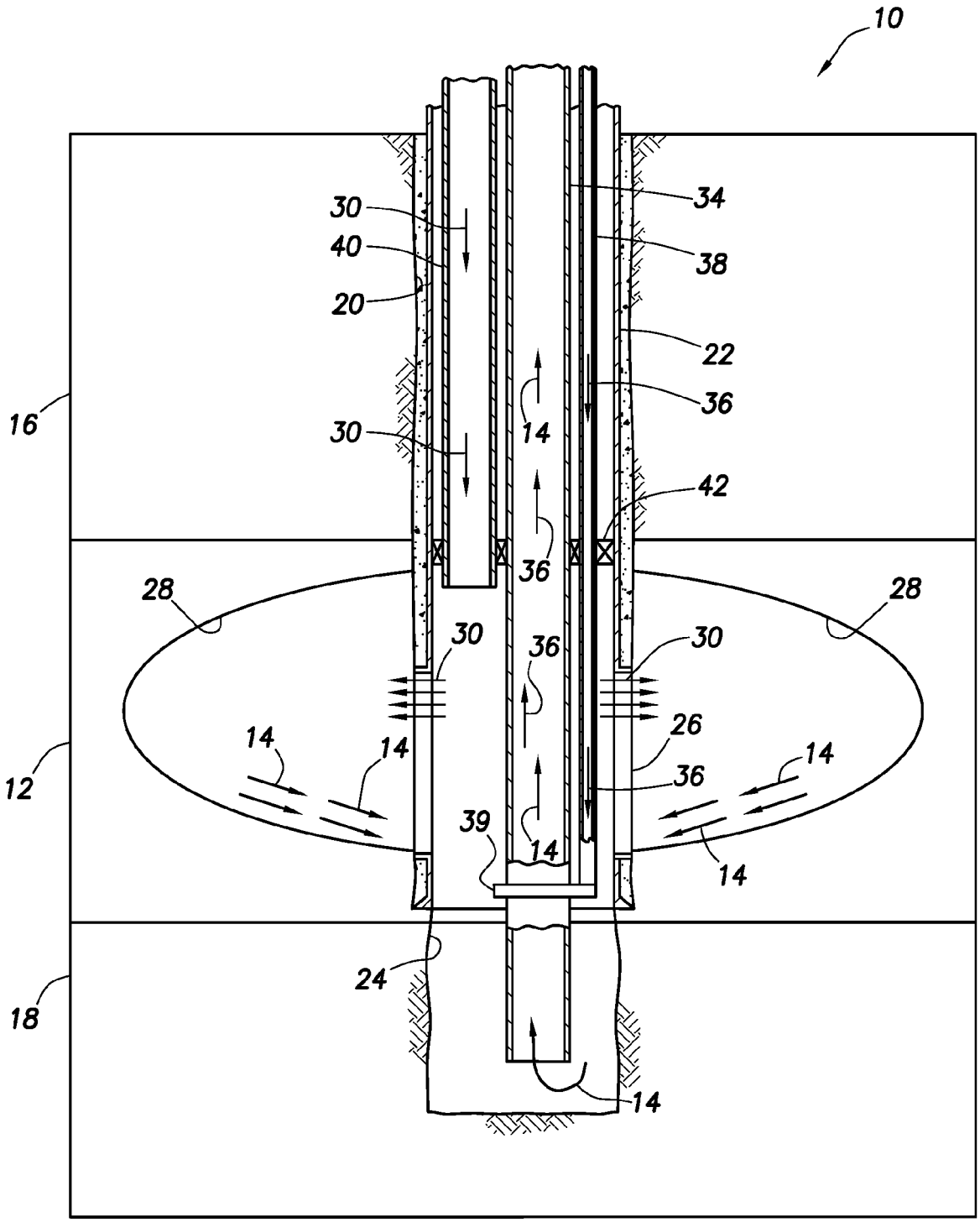
FIG. 6 is a schematic partially cross-sectional view of yet another completed well system embodying principles of the present disclosure.

In FIG. 6, the techniques of FIGS. 4 & 5 are combined, i.e., the fluid 30 is injected into the formation 12 via the injection string 40, and the fluid 36 is injected into the production string 34 via the injection string 38. This demonstrates that any number and combination of the techniques described herein (as well as techniques not described herein) may be utilized in keeping with the principles of this disclosure.

Figure 7:
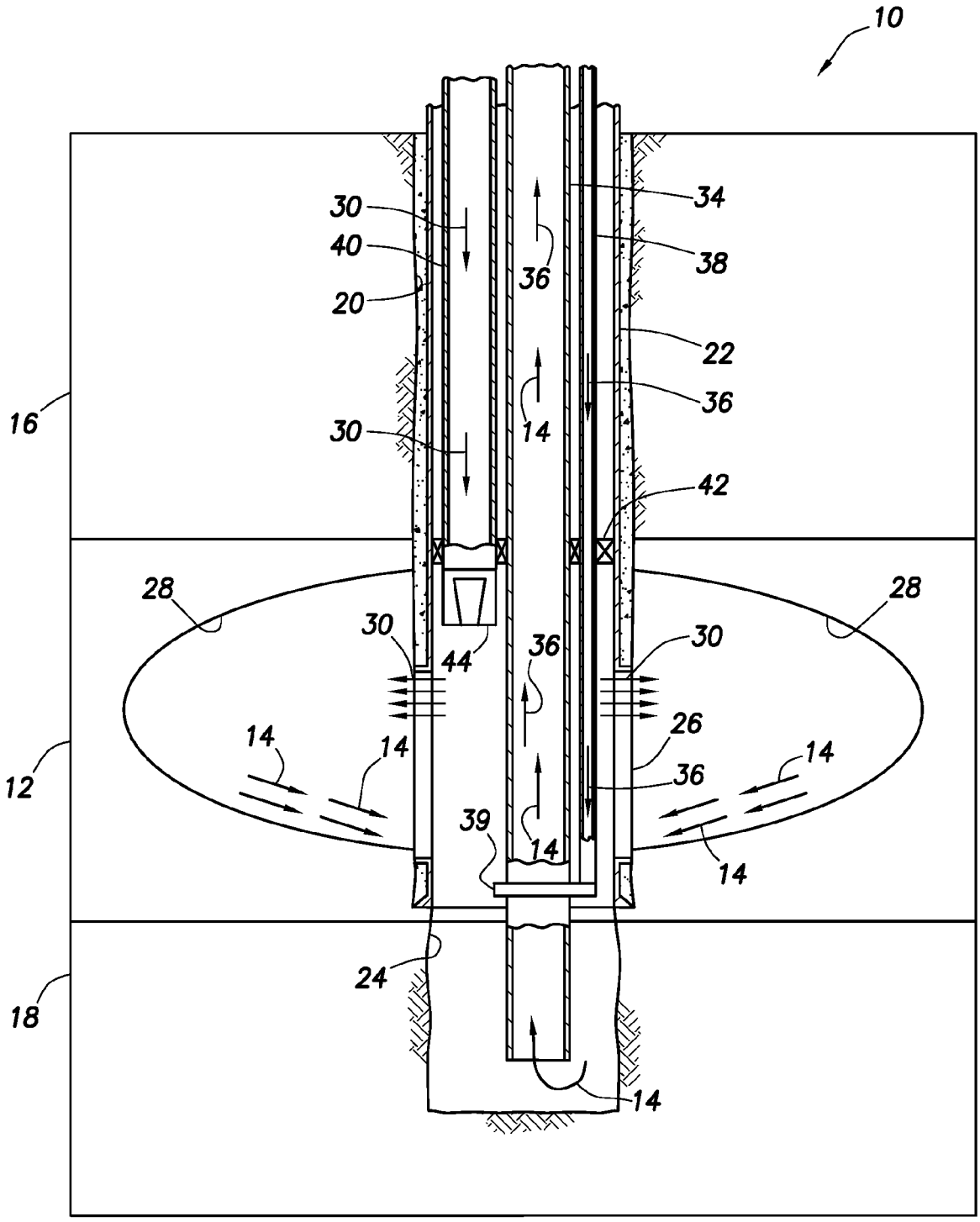
FIG. 7 is a schematic partially cross-sectional view of a further completed well system embodying principles of the present disclosure.

In FIG. 7, a pulsing tool 44 is used with the injection string 40 to continuously vary a flow rate of the fluid 30 as it is being injected into the formation 12. Suitable pulsing tools are described in U.S. Pat. No. 7,404,416, and in U.S. Pat. No. 7,909,094. The entire disclosures of these prior patents are incorporated herein by this reference.

This varying of the flow rate of the fluid 30 into the formation 12 is beneficial, in that it optimizes distribution of the fluid in the formation and thereby helps to heat and mobilize a greater proportion of the hydrocarbons 14 in the formation. Note that the flow rate of the fluid 30 as varied by the pulsing tool 44 preferably does not alternate between periods of flow and periods of no flow, or between periods of forward flow and periods of backward flow.

Instead, the flow of the fluid 30 is preferably maintained in a forward direction (i.e., flowing into the formation 12) while the flow rate varies or pulses. This may be considered as an "AC" component of the fluid 30 flow rate imposed on a positive base flow rate of the fluid.

Figure 8:
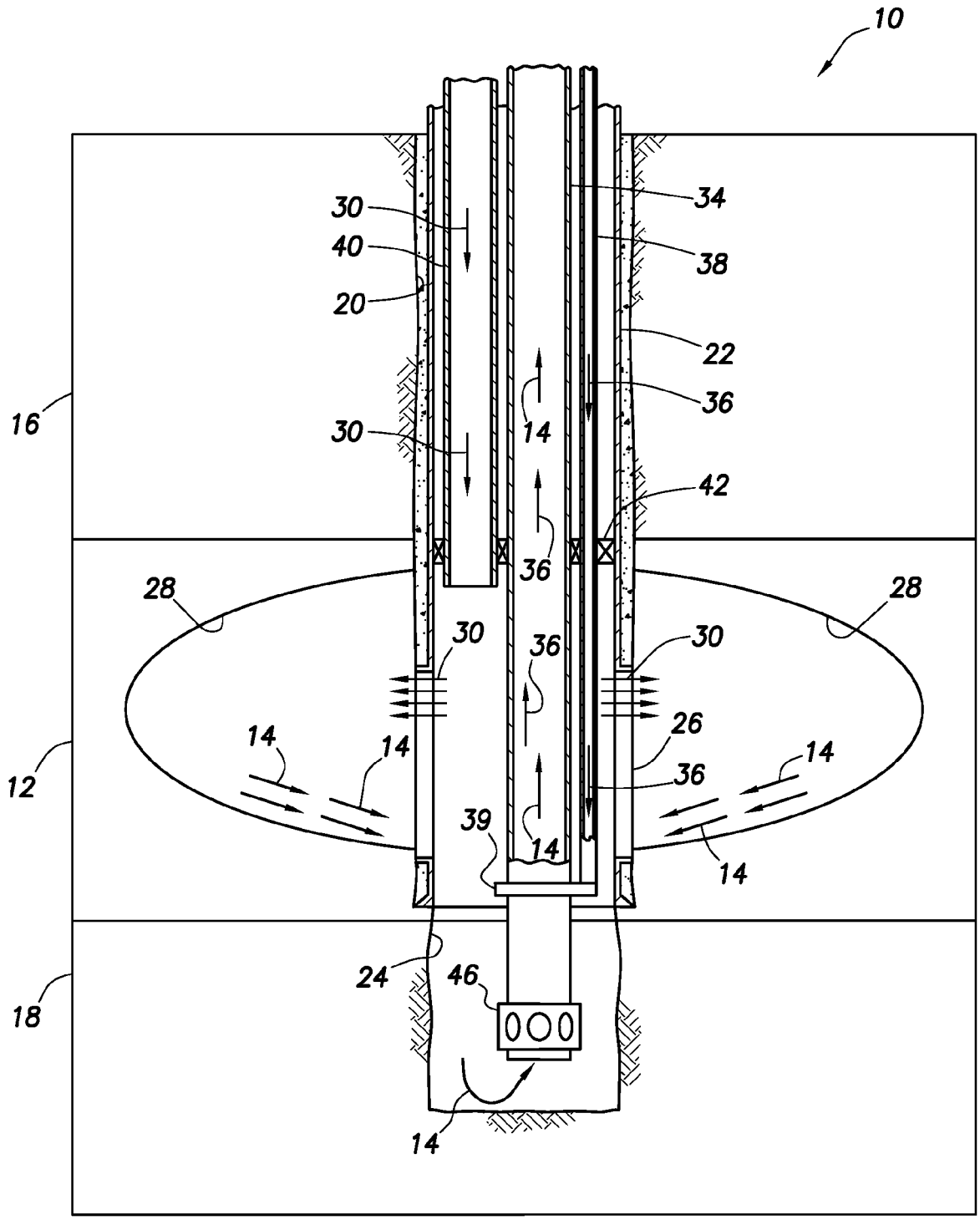
FIG. 8 is a schematic partially cross-sectional view of a still further completed well system embodying principles of the present disclosure.

In FIG. 8, the configuration of the well system 10 is similar in most respects to the system as depicted in FIG. 6. However, the production string 34 has a phase control valve 46 connected at a lower end of the production string.

The phase control valve 46 prevents steam or other gases from being produced along with the hydrocarbons 14 from the sump portion 24. A suitable phase control valve for use in the system 10 is described in U.S. Pat. No. 7,866,400. The entire disclosure of this prior patent is incorporated herein by this reference.

Figure 9:
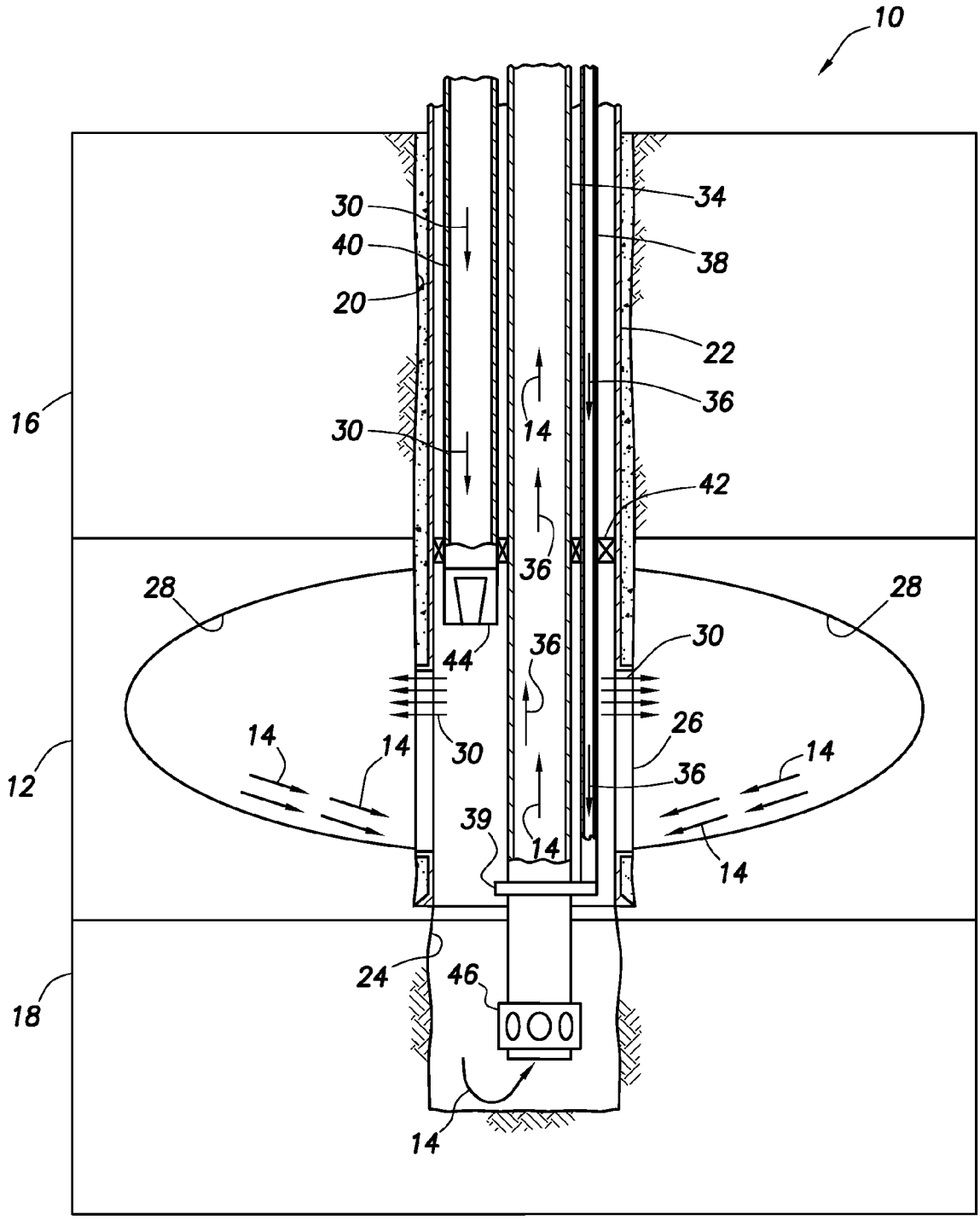
FIG. 9 is a schematic partially cross-sectional view of another completed well system embodying principles of the present disclosure.

In FIG. 9, both of the pulsing tool 44 and the phase control valve 46 are used with the respective injection string 40 and production string 34. Again, any of the features described herein may be combined in the well system 10 as desired, without departing from the principles of this disclosure.

Figure 10:
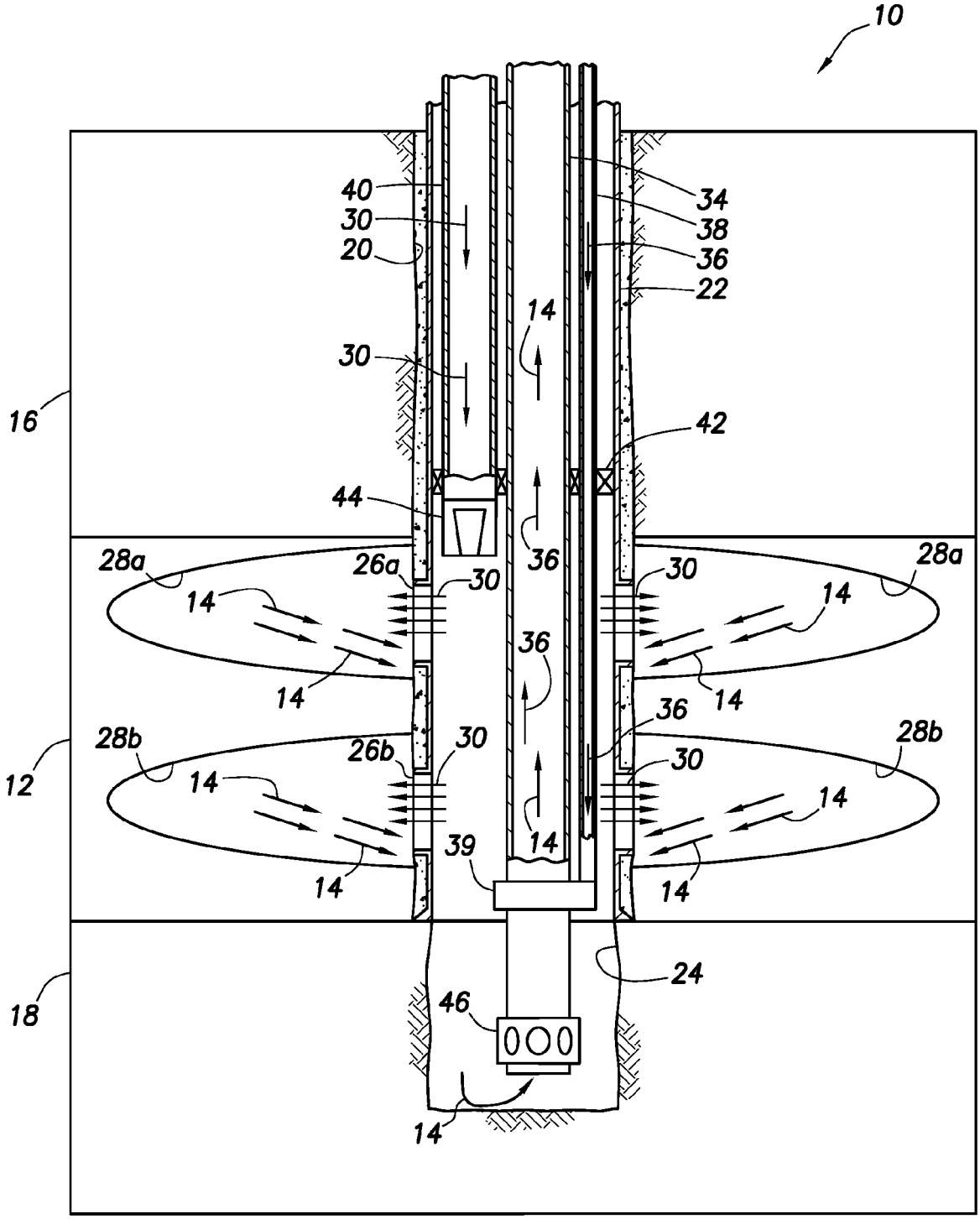
FIG. 10 is a schematic partially cross-sectional view of yet another completed well system embodying principles of the present disclosure.

In FIG. 10, multiple inclusion initiation tools 26*a*, 26*b* are used to propagate inclusions 28*a*, 28*b* at respective multiple depths in the formation 12. The fluid 30 is injected into each of the inclusions 28*a*, 28*b* and the hydrocarbons 14 are received into the wellbore 20 from each of the inclusions 28*a*, 28*b*.

Thus, it will be appreciated that inclusions 28 may be formed at multiple different depths in a formation, and in other embodiments inclusions may be formed in multiple formations, in keeping with the principles of this disclosure. For example, in the embodiment of FIG. 10, there could be a relatively impermeable lithology (e.g., a layer of shale, etc.) between the upper and lower sets of inclusions 28*a*, 28*b*.

As discussed above, the inclusion propagation tool 26 could be similar to any of the tools described in several previously filed patent applications. Most of these previously described tools involve expansion of a portion of a casing string to, for example, increase compressive stress in a radial direction relative to a wellbore.

However, it should be understood that it is not necessary to expand casing (or a tool interconnected in a casing string) in keeping with the principles of this disclosure. In FIGS. 11-19, a method is representatively illustrated for forming the inclusions 28 in the system 10 without expanding casing.

Figure 11:
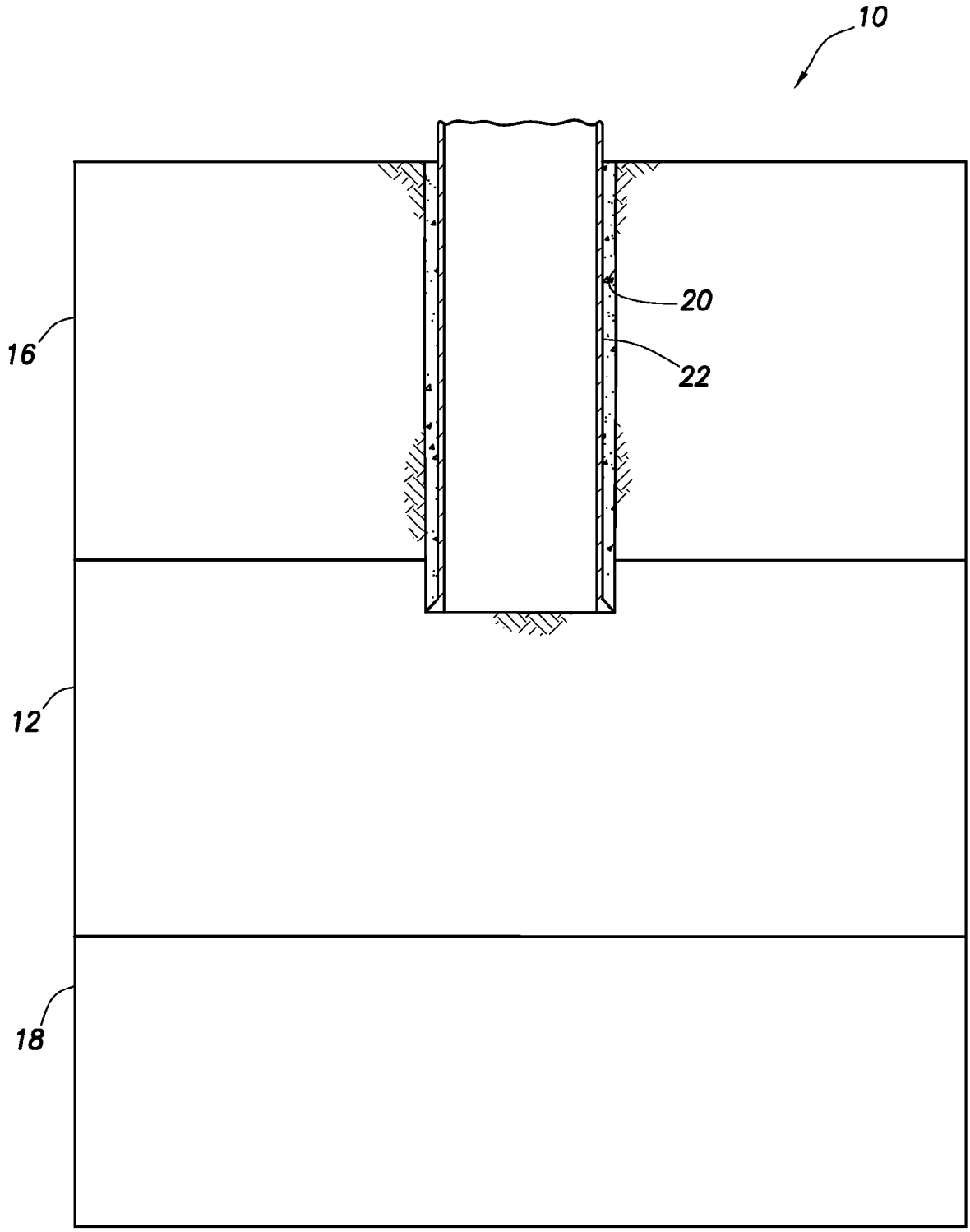
FIG. 11 is a schematic cross-sectional view showing initial steps (e.g., installation of casing in a wellbore) in another method of producing bitumen from the formation.

FIG. 11 depicts the method and system 10 after the wellbore 20 has been drilled into the formation 12, and the casing string 22 has been cemented in the wellbore. Note that, in this example, the casing string 22 does not extend across a portion of the formation 12 in which the inclusions 28 are to be initiated, and the casing string does not include an inclusion initiation tool 26.

Figure 12:
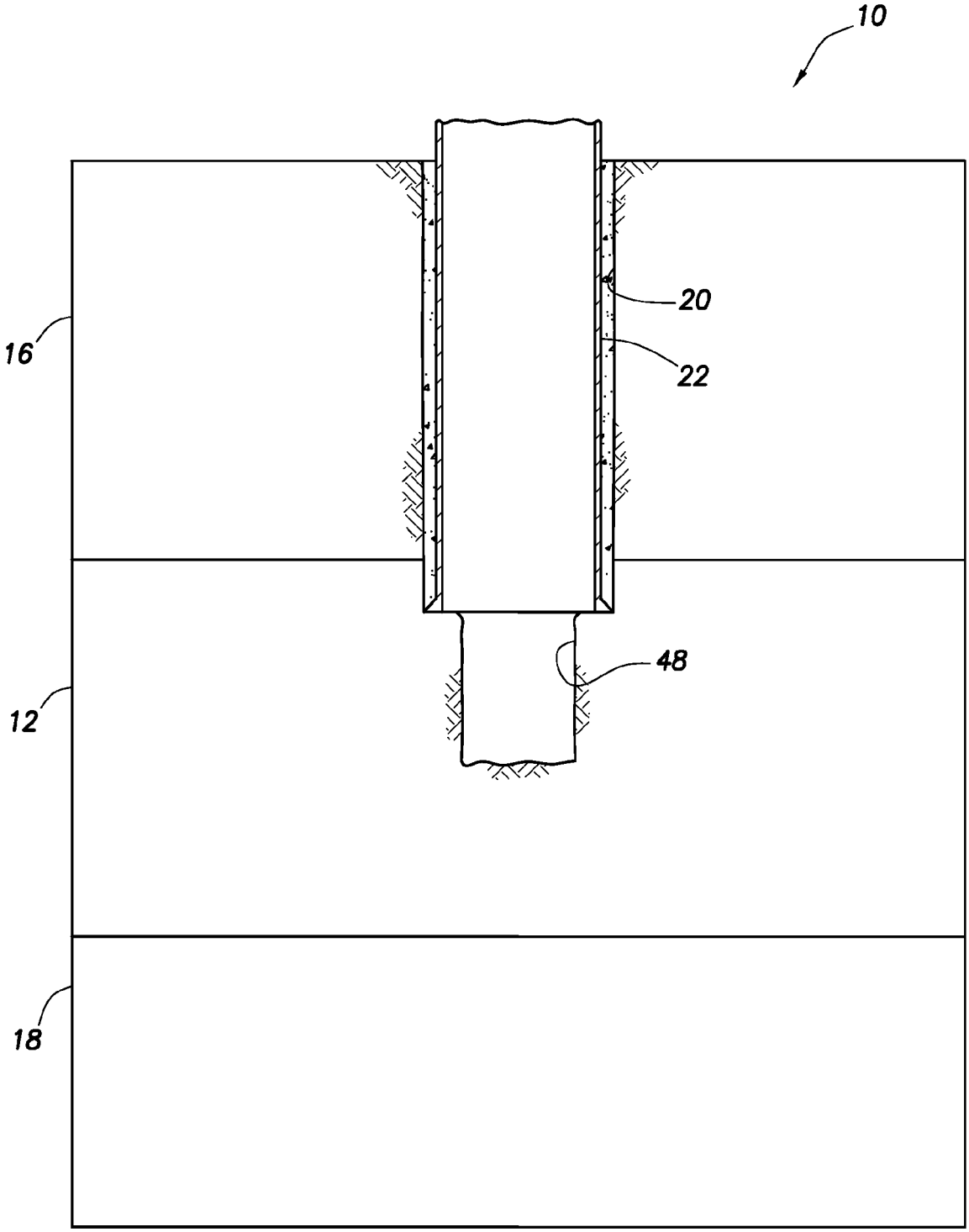
FIG. 12 is a schematic cross-sectional view of the method after drilling of an open hole below the casing.

In FIG. 12, an intermediate open hole wellbore portion 48 is drilled below the lower end of the casing string 22. A diameter of the wellbore portion 48 may be equivalent to (and in other embodiments could be somewhat smaller than or larger than) a body portion of an inclusion initiation tool 26 installed in the wellbore portion 48 as described below.

Figure 13:
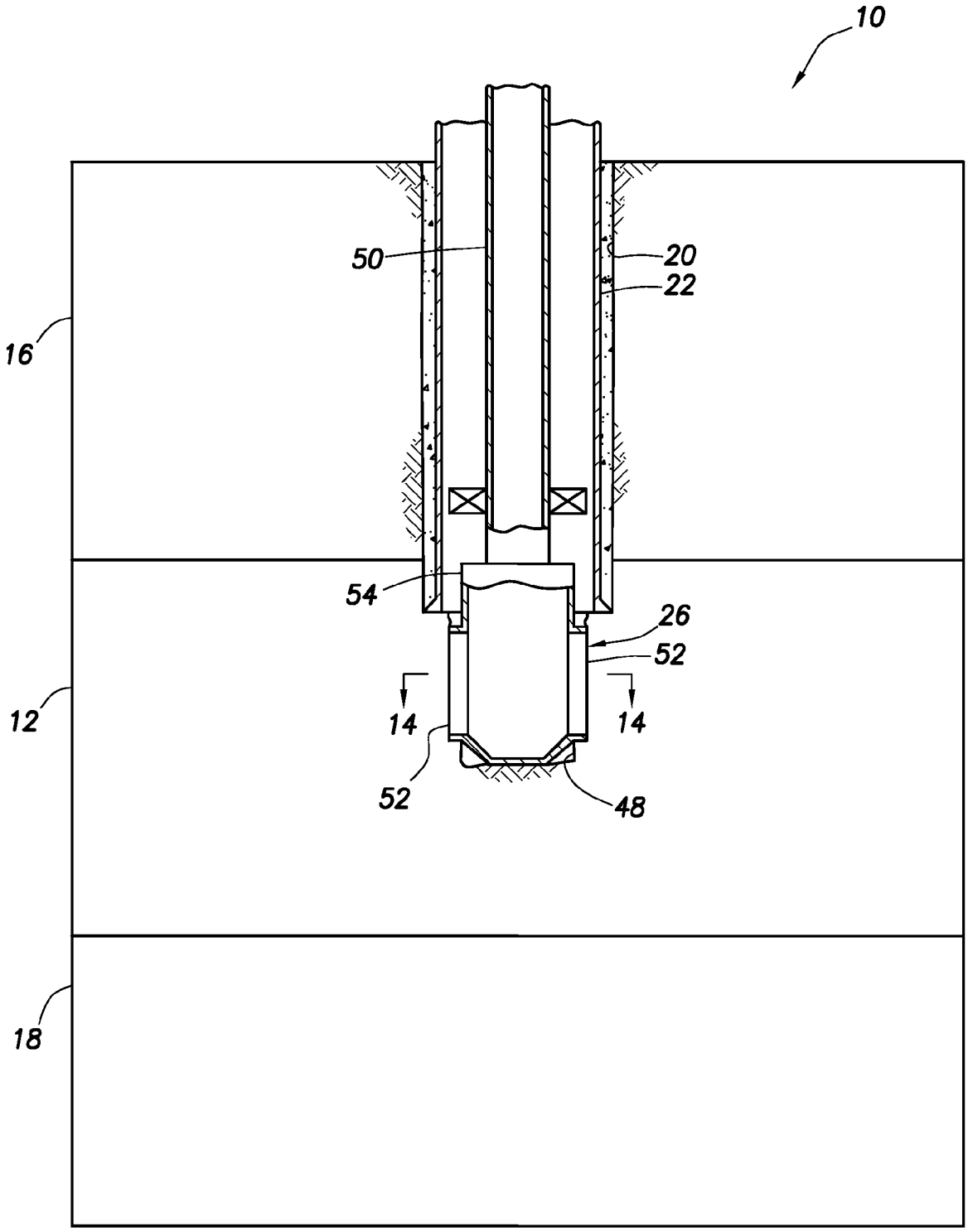
FIG. 13 is a schematic partially cross-sectional view of the method after installation of a work string.

In FIG. 13, the inclusion initiation tool 26 is conveyed into the wellbore 20 on a tubular work string 50, and is installed in the wellbore portion 48. Force is used to drive the tool 26 through the earth surrounding the wellbore portion 48 below the casing string 22, since at least projections 52 extend outwardly from the body 54 of the tool and have a larger lateral dimension as compared to the diameter of the wellbore portion 48. The body 54 could also have a diameter greater than a diameter of the wellbore portion 48 if, for example, it is desired to increase radial compressive stress in the formation 12.

Figure 14:
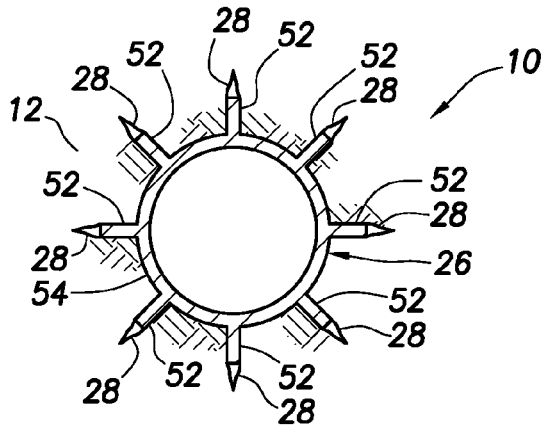
FIG. 14 is a schematic cross-sectional view of a tool for initiating increased permeability inclusions in the formation.

In FIG. 14, a cross-sectional view of the tool 26 driven into the formation 12 is representatively illustrated. In this view, it may be seen that the projections 52 extend outward into the formation 12 to thereby initiate the inclusions 28.

Although the tool 26 is depicted in FIG. 14 as having eight equally radially spaced apart projections 52, it should be understood that the tool could be constructed with any number of projections (including one), and that any number of inclusions 28 may be initiated using the tool. For example, the tool 26 could include two projections 52 spaced 180 degrees apart for initiation of two inclusions 28.

Such a tool 26 could then be raised, azimuthally rotated somewhat, and then driven into the formation 12 again in order to initiate two additional inclusions 28. This process could be repeated as many times as desired to initiate as many inclusions 28 as desired.

The inclusions 28 may be propagated outward into the formation 12 immediately after they are initiated or sometime thereafter, and the inclusions may be propagated sequentially, simultaneously or in any order in keeping with the principles of this disclosure. Any of the techniques described in the previous patent applications mentioned above (e.g., U.S. Pat. Nos. 7,832,477, 7,640,982, 7,647,966, 7,640,975, and 7,814,978) for initiating and propagating the inclusions 28 may be used in the system 10 and associated methods described herein.

Figure 15:
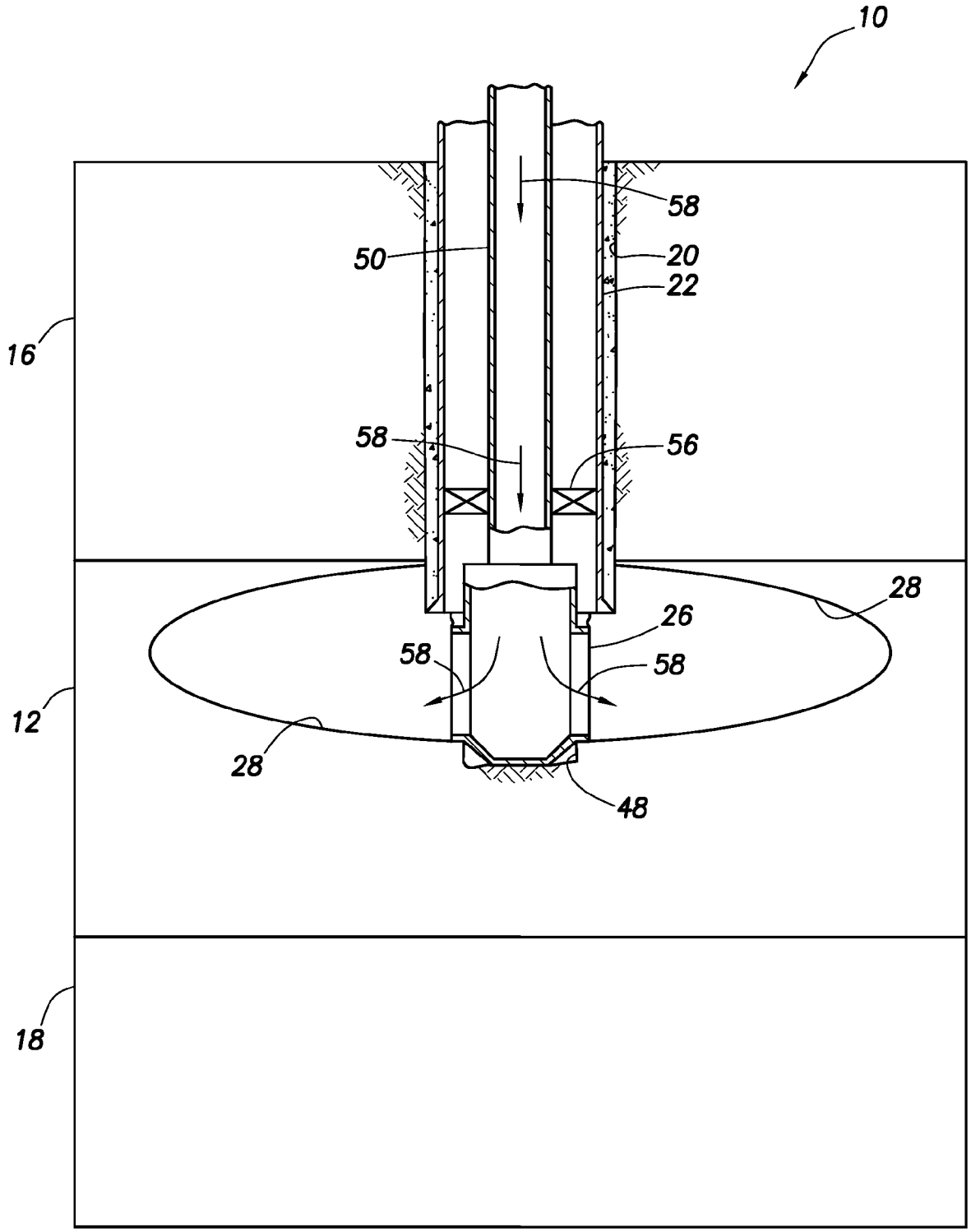
FIG. 15 is a schematic partially cross-sectional view of the method following initiation of increased permeability inclusions in the formation.

In FIG. 15, the inclusions 28 have been propagated outward into the formation 12. This may be accomplished by setting a packer 56 in the casing string 22 and pumping fluid 58 through the work string 50 and outward into the inclusions 28 via the projections 52 on the tool 26.

The tool 26 may or may not be expanded (e.g., using hydraulic actuators or any of the techniques described in the previous patent applications mentioned above) prior to or during the process of pumping the fluid 58 into the formation 12 to propagate the inclusions 28. In addition, the fluid 58 may be laden with sand or another proppant, so that after propagation of the inclusions 28, a high permeability flowpath will be defined by each of the inclusions for later injection of the fluid 30 and production of the hydrocarbons 14 from the formation 12.

Note that it is not necessary for the tool 26 to include the projections 52. The body 54 could be expanded radially outward (e.g., using hydraulic actuators, etc.), and the fluid 58 could be pumped out of the expanded body to form the inclusions 28.

Figure 16:
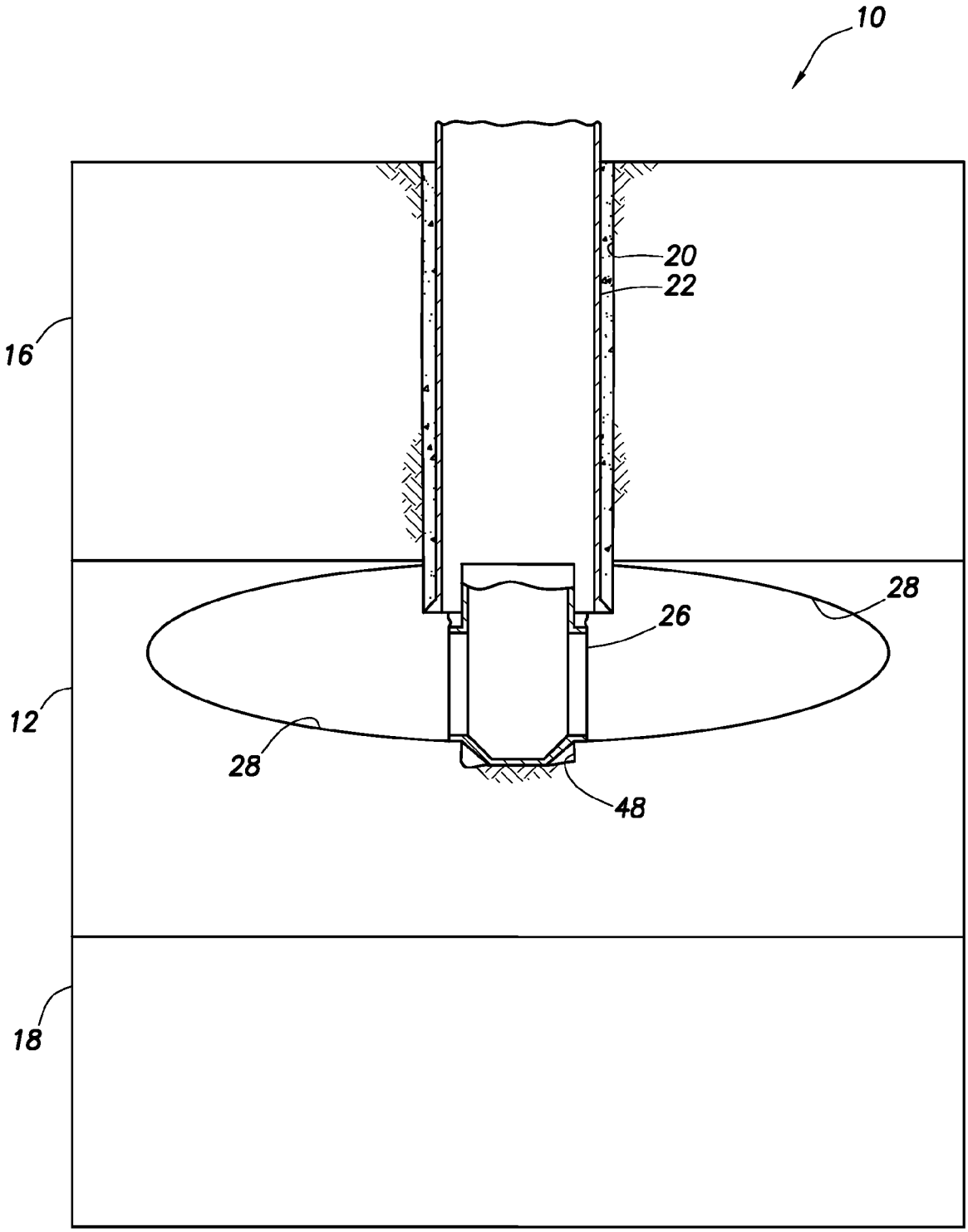
FIG. 16 is a schematic partially cross-sectional view of the method after retrieval of the work string.

In FIG. 16, the work string 50 has been retrieved from the well, leaving the tool 26 in the wellbore portion 48 after propagation of the inclusions 28. Alternatively, the tool 26 could be retrieved with the work string 50, if desired.

Figure 17:
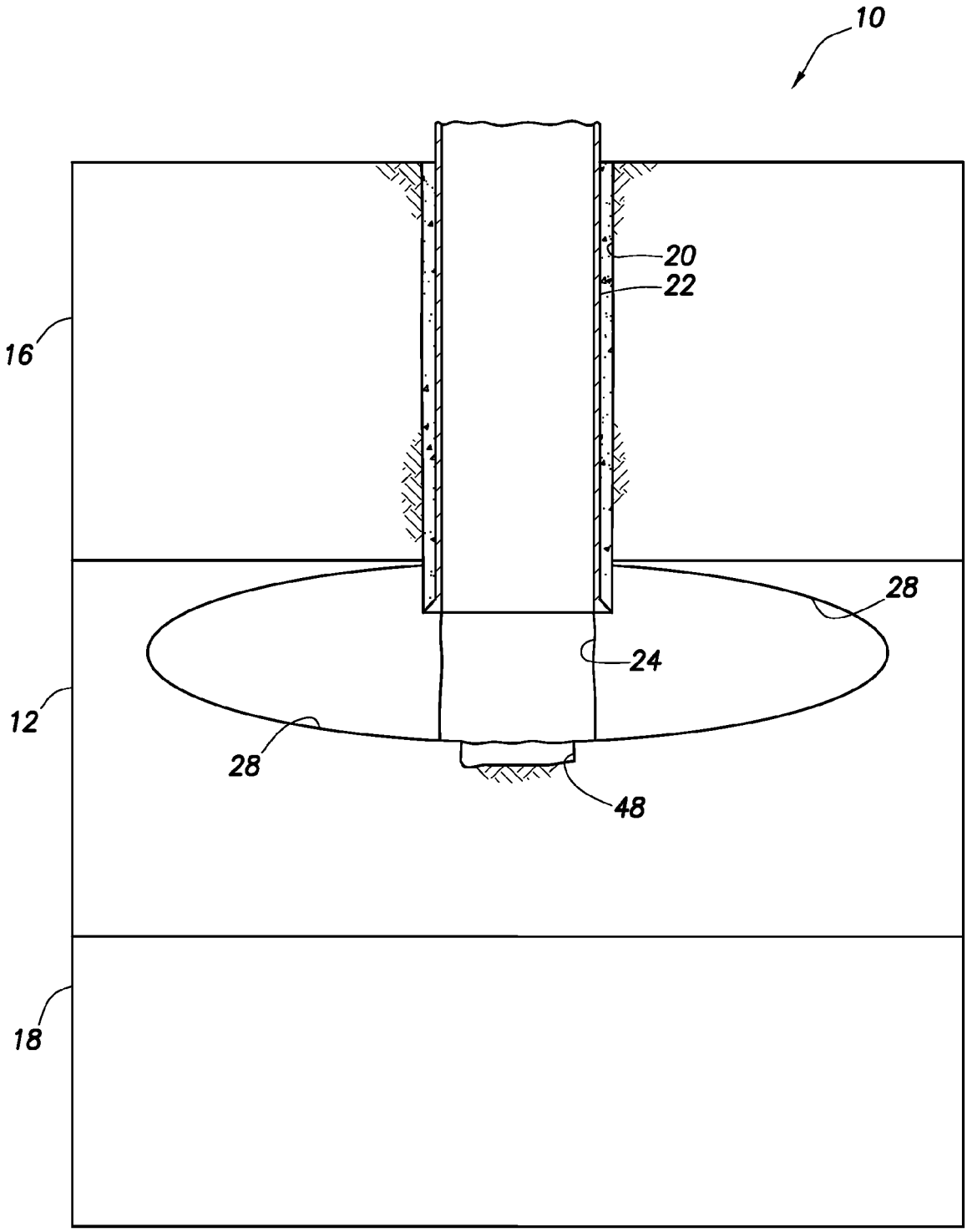
FIG. 17 is a partially cross-sectional view of the method after retrieval of the inclusion initiation tool.

In FIG. 17, the wellbore portion 48 has been enlarged to form the sump portion 24 for eventual accumulation of the hydrocarbons 14 therein. In this embodiment, the wellbore portion 48 is enlarged when a washover tool (not shown) is used to retrieve the tool 26 from the wellbore portion.

However, if the tool 26 is retrieved along with the work string 50 as described above, then other techniques (such as use of an underreamer or a drill bit, etc.) may be used to enlarge the wellbore portion 48. Furthermore, in other embodiments, the wellbore portion 48 may itself serve as the sump portion 24 without being enlarged at all.

Figure 18:
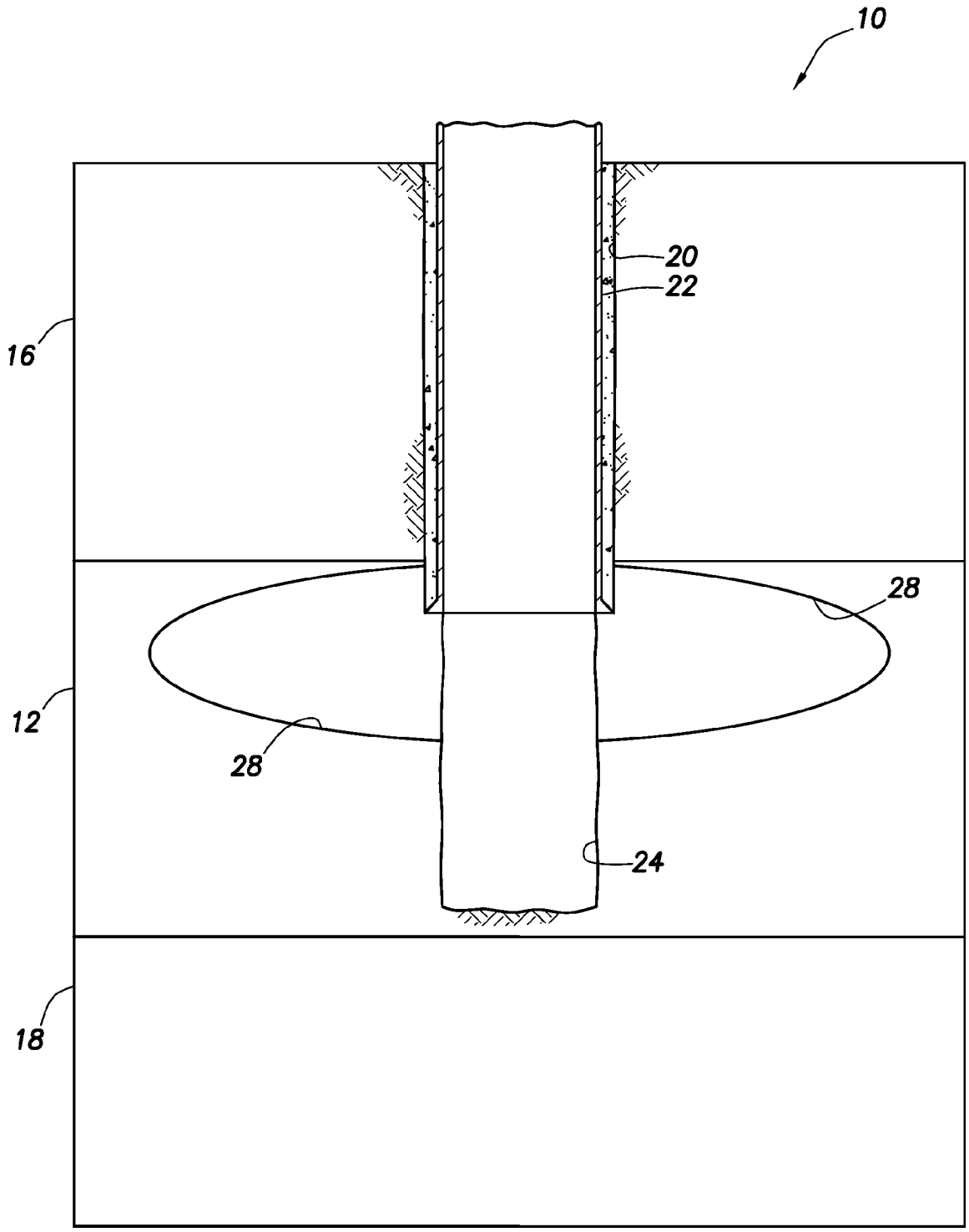
FIG. 18 is a cross-sectional view of the method after enlargement of a sump portion of the wellbore.

In FIG. 18, the sump portion 24 has been extended further downward in the formation 12. The sump portion 24 could extend into the layer 18, if desired, as depicted in FIGS. 2-10.

Figure 19:
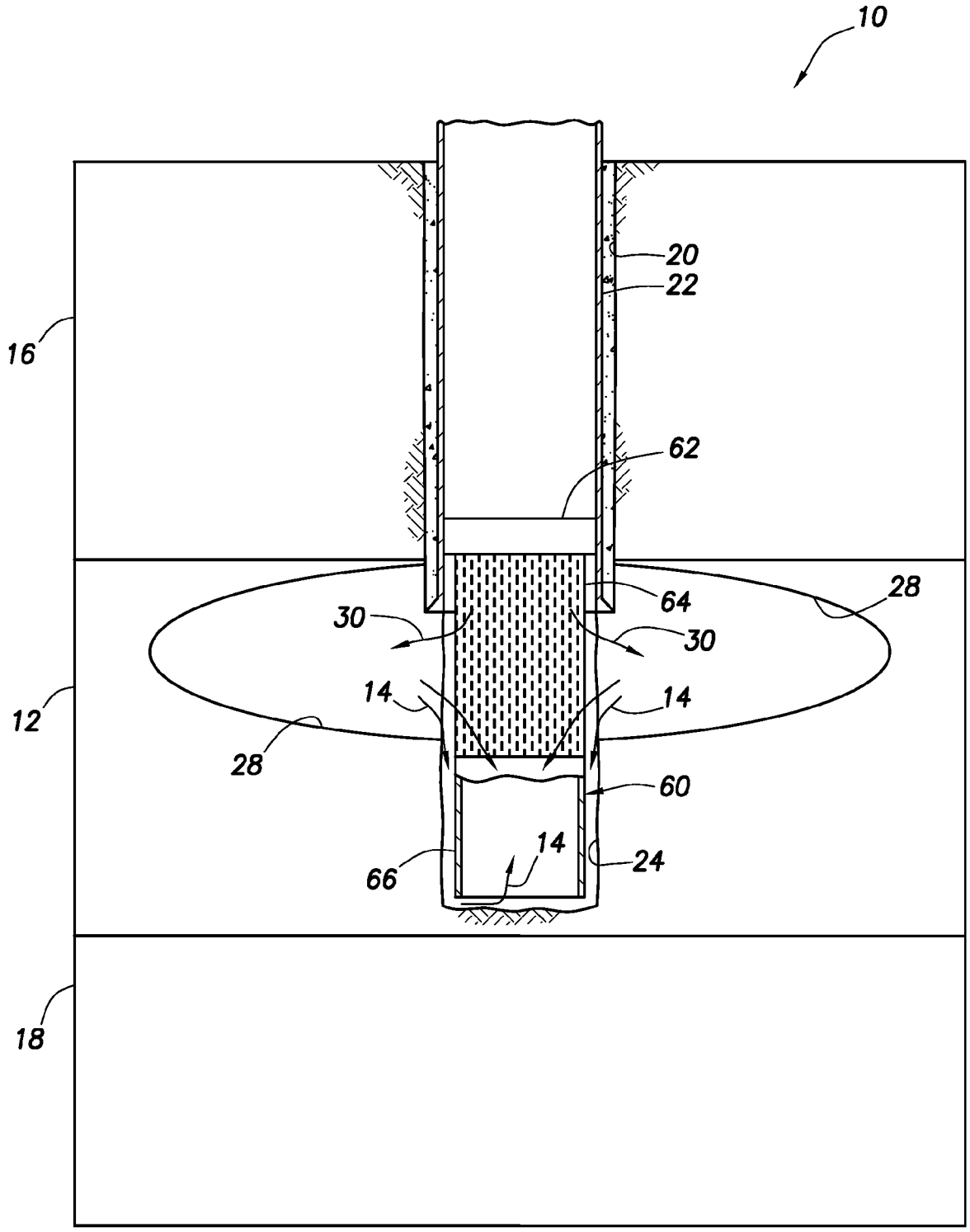
FIG. 19 is a cross-sectional view of the method after installation of a liner string into the sump portion of the wellbore.

In FIG. 19, a tubular liner string 60 has been installed in the well, with a liner hanger 62 sealing and securing an upper end of the liner string in the casing string 22. A perforated or slotted section of liner 64 extends into the wellbore portion 24 opposite the inclusions 28, and an un-perforated or blank section of liner 66 extends into the wellbore portion below the inclusions.

The perforated section of liner 64 allows the fluid 30 to be injected from within the liner string 60 into the inclusions 28. The perforated section of liner 64 may also allow the hydrocarbons 14 to flow into the liner string 60 from the inclusions 28. If the un-perforated section of liner 66 is open at its lower end, then the hydrocarbons 14 may also be allowed to flow into the liner string 60 through the lower end of the liner.

The well may now be completed using any of the techniques described above and depicted in FIGS. 2-10. For example the production string 34 may be installed (with its lower end extending into the liner string 60), along with any of the injection strings 38, 40, the pulsing tool 44 and/or the phase control valve 46, as desired.

Figure 20:
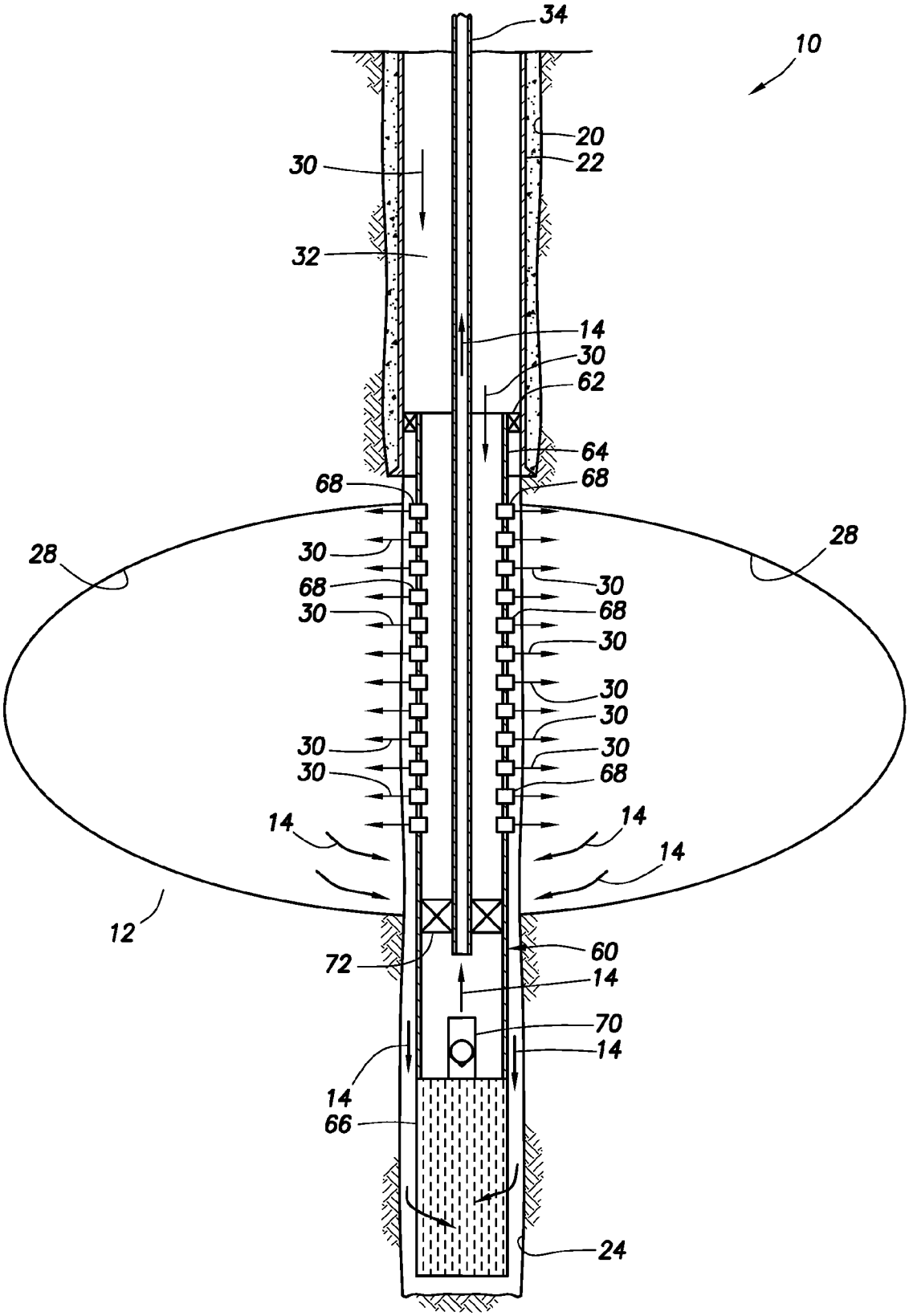
FIG. 20 is a cross-sectional view of another completed well system embodying principles of the present disclosure.

Another completion option is representatively illustrated in FIG. 20. In this completion configuration, the upper liner 64 is provided with a series of longitudinally distributed nozzles 68.

The nozzles 68 serve to evenly distribute the injection of the fluid 30 into the inclusions 28, at least in part by maintaining a positive pressure differential from the interior to the exterior of the liner 64. The nozzles 68 may be appropriately configured (e.g., by diameter, length, flow restriction, etc.) to achieve a desired distribution of flow of the fluid 30, and it is not necessary for all of the nozzles to be the same configuration.

The lower liner 66 is perforated or slotted to allow the hydrocarbons 14 to flow into the liner string 60. A flow control device 70 (e.g., a check valve, pressure relief valve, etc.) provides one-way fluid communication between the upper and lower liners 64, 66.

In operation, injection of the fluid 30 heats the hydrocarbons 14, which flow into the wellbore 20 and accumulate in the sump portion 24, and enter the lower end of the production string 34 via the flow control device 70. The fluid 30 can periodically enter the lower end of the production string 34 (e.g., when a level of the hydrocarbons 14 in the sump portion drops sufficiently) and thereby aid in lifting the hydrocarbons 14 upward through the production string.

Alternatively, the flow control device 70 could also include a phase control valve (such as the valve 46 described above) to prevent steam or other gases from flowing into the upper liner 64 from the lower liner 66 through the flow control device. As another alternative, if a packer 72 is not provided for sealing between the production string 34 and the liner string 60, then the phase control valve 46 could be included at the lower end of the production string as depicted in FIGS. 8-10 and described above.

Any of the other completion options described above may also be included in the configuration of FIG. 20. For example, the fluid 30 could be injected via an injection string 40, a relatively less dense fluid 36 could be injected via another injection string 38 and mandrel 39, a pulsing tool 44 could be used to vary the flow rate of the fluid 30, etc.

It may now be fully appreciated that the above description of the well system 10 and associated methods provides significant advancements to the art of producing relatively heavy weight hydrocarbons from earth strata. The system 10 and methods are particularly useful where the strata are too deep for conventional surface mining and too shallow for conventional SAGD operations.

Some particularly useful features of the system 10 and methods are that only a single wellbore 20 is needed to both inject the fluid 30 and produce the hydrocarbons 14, the fluid may be injected simultaneously with production of the hydrocarbons, and production of the hydrocarbons is substantially immediate upon completion of the well. The system 10 and methods offer a very economical and effective way of producing large deposits of shallow bitumen which cannot currently be thermally produced using conventional completion techniques. Fewer wells are required, which reduces the environmental impact of such production.

The methods do not require a heat-up phase of 3 to 4 months as with conventional SAGD techniques, nor do the methods preferably involve a cyclic steaming process in which production ceases during the steam injection phase. Instead, the hydrocarbons 14 are preferably continuously heated by injection of the fluid 30, and continuously produced during the injection, providing substantially immediate return on investment.

The above disclosure provides to the art a method of producing hydrocarbons 14 from a subterranean formation 12. The method includes the steps of: propagating at least one generally planar inclusion 28 outward from a wellbore 20 into the formation 12; injecting a fluid 30 into the inclusion 28, thereby heating the hydrocarbons 14; and during the injecting step, producing the hydrocarbons 14 from the wellbore 20.

The hydrocarbons 14 may comprise bitumen. The hydrocarbons 14 producing step may include flowing the hydrocarbons into the wellbore 20 at a depth of between approximately 70 meters and approximately 140 meters in the earth.

The fluid 30 may comprise steam. The fluid 30 may be injected into the same inclusion 28 from which the hydrocarbons 14 are produced.

The fluid 30 may be injected into an upper portion of the inclusion 28 which is above a lower portion of the inclusion from which the hydrocarbons 14 are produced. The fluid 30 may be injected at a varying flow rate while the hydrocarbons 14 are being produced.

The hydrocarbons 14 may be produced through a tubular string 34 extending to a position in the wellbore 20 which is below the inclusion 28. A phase control valve 46 may prevent production of the fluid 30 with the hydrocarbons 14 through the tubular string 34.

The inclusion 28 propagating step may include propagating a plurality of the inclusions into the formation 12 at one depth. The propagating step may also include propagating a plurality of the inclusions 28 into the formation 12 at another depth. The producing step may include producing the hydrocarbons 14 from the inclusions 28 at both depths.

The inclusion 28 propagating step may be performed without expanding a casing in the wellbore 20.

Also provided by the above disclosure is a well system 10 for producing hydrocarbons 14 from a subterranean formation 12 intersected by a wellbore 20. The system 10 includes at least one generally planar inclusion 28 extending outward from the wellbore 20 into the formation 12.

A fluid 30 is injected into the inclusion 28. The hydrocarbons 14 are heated as a result of the injected fluid 30.

The hydrocarbons 14 are produced through a tubular string 34 which extends to a location in the wellbore 20 below the inclusion 28. The hydrocarbons 14 are received into the tubular string 34 at that location.

Only the single wellbore 20 may be used for injection of the fluid 30 and production of the hydrocarbons 14. A pulsing tool 44 may vary a flow rate of the fluid 30 as it is being injected.

The fluid 30 may be injected via an annulus 32 formed between the tubular string 34 and the wellbore 20. The fluid 30 may be injected via a tubular injection string 40.

A flow control device 70 may provide one-way flow of the hydrocarbons 14 into the tubular string 34 from a portion 24 of the wellbore 20 below the inclusion 28.

Also described above is a method of producing hydrocarbons 14 from a subterranean formation 12, with the method including the steps of: propagating at least one generally planar inclusion 28 outward from a wellbore 20 into the formation 12; injecting a fluid 30 into the inclusion 28, thereby heating the hydrocarbons 14, the injecting step including varying a flow rate of the fluid 30 into the inclusion 28 while the fluid 30 is continuously flowed into the inclusion 28; and during the injecting step, producing the hydrocarbons 14 from the wellbore 20.

The above disclosure also provides a method of propagating at least one generally planar inclusion 28 outward from a wellbore 20 into a subterranean formation 12. The method includes the steps of: providing an inclusion initiation tool 26 which has at least one laterally outwardly extending projection 52, a lateral dimension of the inclusion initiation tool 26 being larger than an internal lateral dimension of a portion 48 of the wellbore 20; forcing the inclusion initiation tool 26 into the wellbore portion 48, thereby forcing the projection 52 into the formation 12 to thereby initiate the inclusion 28; and then pumping a propagation fluid 58 into the inclusion 28, thereby propagating the inclusion 28 outward into the formation 12.

A body 54 of the inclusion initiation tool 26 may have a lateral dimension which is larger than the internal lateral dimension of the wellbore portion 48, whereby the tool forcing step further comprises forcing the body 54 into the wellbore portion 48, thereby increasing radial compressive stress in the formation 12.

The fluid pumping step may include pumping the fluid 58 through the projection 52.

The projection forcing step may be performed multiple times, with the inclusion initiation tool 26 being azimuthally rotated between the projection forcing steps.

The method may include the step of expanding the inclusion initiation tool 26 in the wellbore portion 48. The expanding step may be performed prior to, or during, the pumping step.

The method may include the step of retrieving the inclusion initiation tool 26 from the wellbore 20.

The method may include the steps of injecting a heating fluid 30 into the inclusion 28, thereby heating hydrocarbons 14 in the formation 12; and during the injecting step, producing the hydrocarbons 14 from the wellbore 20.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A method of propagating at least one generally planar inclusion outward from a wellbore into a subterranean formation, the method comprising the steps of:

providing in the wellbore an inclusion initiation tool which has at least one laterally outwardly extending projection, a lateral dimension of the inclusion initiation tool being larger than an internal lateral dimension of a portion of the wellbore during placement of the inclusion initiation tool in said portion of the wellbore;

then forcing the inclusion initiation tool into the wellbore portion, thereby forcing the projection into the formation to thereby initiate the inclusion; and then pumping a propagation fluid into the inclusion, thereby propagating the inclusion outward into the formation.

2. The method of claim 1, wherein a body of the inclusion initiation tool has a lateral dimension which is larger than the internal lateral dimension of the wellbore portion, whereby the tool forcing step further comprises forcing the body into the wellbore portion, thereby increasing radial compressive stress in the formation.

3. The method of claim 1, wherein the fluid pumping step further comprises pumping the fluid through the projection.

4. The method of claim 1, wherein the projection forcing step is performed multiple times, with the inclusion initiation tool being azimuthally rotated between the projection forcing steps.

5. The method of claim 1, further comprising the step of expanding the inclusion initiation tool in the wellbore portion.

6. The method of claim 5, wherein the expanding step is performed prior to the pumping step.

7. The method of claim 5, wherein the expanding step is performed during the pumping step.

8. The method of claim 1, further comprising the step of retrieving the inclusion initiation tool from the wellbore.

9. The method of claim 1, further comprising the steps of injecting a heating fluid into the inclusion, thereby heating hydrocarbons in the formation; and during the injecting step, producing the hydrocarbons from the wellbore.

10. The method of claim 9, wherein the hydrocarbons comprise bitumen.

11. The method of claim 9, wherein the producing step further comprises flowing the hydrocarbons into the wellbore at a depth of between approximately 70 meters and approximately 140 meters in the earth.

12. The method of claim 9, wherein the heating fluid comprises steam.

13. The method of claim 9, wherein the heating fluid is injected into the same inclusion from which the hydrocarbons are produced.

14. The method of claim 9, wherein the heating fluid is injected into an upper portion of the inclusion which is above a lower portion of the inclusion from which the hydrocarbons are produced.

15. The method of claim 9, wherein the heating fluid is injected at a varying flow rate while the hydrocarbons are being produced.

16. The method of claim 9, wherein the hydrocarbons are produced through a tubular string extending to a position in the wellbore which is below the inclusion, and wherein a phase control valve prevents production of the heating fluid with the hydrocarbons through the tubular string.

17. The method of claim 1, wherein the wellbore portion is an uncased open hole portion of the wellbore in the tool forcing step.

* * * * *